US008700809B2

(12) United States Patent
Ferragut, II et al.

(10) Patent No.: US 8,700,809 B2
(45) **Date of Patent: *Apr. 15, 2014**

(54) SUBSTANCE COMMUNICATING DEVICE WITH ACTIVATABLE CONNECTOR AND CYCLE STRUCTURE

(75) Inventors: Nelson J. Ferragut, II, Stevensville, MI (US); Joel A. Luckman, Benton Harbor, MI (US); Richard A. McCoy, Stevensville, MI (US); Andre O. Pires, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 580 days.

This patent is subject to a terminal disclaimer.

(21) Appl. No.: 12/643,128

(22) Filed: Dec. 21, 2009

(65) Prior Publication Data

US 2011/0153871 A1 Jun. 23, 2011

(51) Int. Cl.
*G06F 3/00* (2006.01)
*F16L 37/38* (2006.01)

(52) U.S. Cl.
USPC ..... 710/8; 251/149

(58) Field of Classification Search
USPC ..... 710/8
See application file for complete search history.

(56) References Cited

U.S. PATENT DOCUMENTS

| | | | | |
|---|---|---|---|---|
| 1,958,206 | A | | 5/1934 | Rubsam |
| 3,101,984 | A | | 8/1963 | Wieckmann |
| 3,258,553 | A | | 6/1966 | Breslin |
| 3,561,506 | A | | 2/1971 | Johnson |
| 3,710,060 | A | | 1/1973 | Brevick |
| 4,068,179 | A | * | 1/1978 | Sample et al. ..... 327/273 |
| 4,148,536 | A | | 4/1979 | Petropoulsos et al. |
| 4,317,969 | A | | 3/1982 | Riegler et al. |
| 4,445,743 | A | | 5/1984 | Bakker |
| 4,591,732 | A | | 5/1986 | Neuenschwander |
| 4,604,505 | A | | 8/1986 | Henninger |
| 4,663,542 | A | | 5/1987 | Buck et al. |
| 4,844,582 | A | | 7/1989 | Giannini |
| 4,964,891 | A | | 10/1990 | Schaefer |
| 5,031,258 | A | | 7/1991 | Shaw |
| 5,207,148 | A | * | 5/1993 | Anderson et al. ..... 99/281 |
| 5,368,275 | A | | 11/1994 | Ketcham et al. |
| 5,385,468 | A | | 1/1995 | Verderber |
| 5,433,623 | A | | 7/1995 | Wakata et al. |
| 5,450,877 | A | | 9/1995 | Graffin |
| 5,713,752 | A | | 2/1998 | Leong et al. |
| 5,784,934 | A | | 7/1998 | Izumisawa |
| 5,828,341 | A | | 10/1998 | Delamater |
| 5,953,129 | A | | 9/1999 | Anderlik et al. |
| 6,176,718 | B1 | | 1/2001 | Skarie et al. |

(Continued)

FOREIGN PATENT DOCUMENTS

| | | |
|---|---|---|
| EP | 0868077 A2 | 9/1998 |
| JP | 60033716 A | 2/1985 |

(Continued)

*Primary Examiner* — Titus Wong

(57) ABSTRACT

A substance communicating device for use in conjunction with an appliance or a system including an appliance and a substance communicating device. The substance communicating device has a service connector component operably engageable with a service connector component of the appliance to permit the communication of a substance between the appliance and the substance communicating device. Information related to the substance can be communicated to the appliance and used to affect the physical cycle of operation of the appliance.

52 Claims, 10 Drawing Sheets

(56) References Cited

U.S. PATENT DOCUMENTS 6,183,264 B1 2/2001 Harsanyi
6,350,148 B1 2/2002 Bartolutti et al.
6,359,270 B1 3/2002 Bridson
6,428,334 B1 8/2002 Skarie et al.
6,445,580 B1 9/2002 Cohen et al.
6,534,951 B2 3/2003 Kawashima
6,559,882 B1 5/2003 Kerchner
6,633,157 B1 10/2003 Yamaki et al.
6,685,491 B2 2/2004 Gergek
6,921,113 B1 7/2005 Vlasblom
6,927,871 B1 8/2005 Silverbrook et al.
6,969,928 B2 * 11/2005 Hanson ..... 307/328
6,973,936 B2 12/2005 Watson
6,981,695 B1 1/2006 Hedlund et al.
6,986,263 B2 * 1/2006 Crisp, III ..... 62/389
7,024,717 B2 4/2006 Hilscher et al.
7,201,005 B2 * 4/2007 Voglewede et al. ..... 62/126
7,207,080 B2 4/2007 Hilscher et al.
7,207,233 B2 4/2007 Wadge
7,209,038 B1 4/2007 Deconinck et al.
7,264,026 B2 9/2007 Gruber et al.
7,291,032 B1 11/2007 Carver et al.
7,354,292 B1 4/2008 Lloyd et al.
7,404,298 B2 7/2008 Kim et al.
7,430,111 B2 9/2008 Lee et al.
7,493,926 B2 2/2009 Weglin
7,584,030 B1 9/2009 Graham
7,618,295 B2 11/2009 McCoy
7,625,246 B2 12/2009 McCoy et al.
7,639,485 B2 12/2009 McCoy
7,651,368 B2 1/2010 Kendall et al.
7,686,127 B2 3/2010 LeClear et al.
7,689,476 B2 * 3/2010 Crisp, III ..... 705/28
7,713,090 B2 5/2010 Kendall et al.
7,740,505 B2 6/2010 McCoy
7,740,506 B2 6/2010 McCoy
7,748,494 B2 7/2010 Leclear et al.
7,751,184 B2 7/2010 McCoy
7,765,332 B2 7/2010 McCoy et al.
7,798,865 B2 9/2010 McCoy et al.
7,810,343 B2 10/2010 McCoy et al.
7,814,944 B2 10/2010 Weglin
7,826,203 B2 11/2010 McCoy
7,841,907 B2 11/2010 McCoy
7,843,697 B2 11/2010 McCoy et al.
7,852,619 B2 12/2010 McCoy
7,865,639 B2 1/2011 McCoy et al.
7,869,201 B2 1/2011 McCoy et al.
7,870,753 B2 1/2011 Marcy, V et al.
7,871,300 B2 1/2011 McCoy et al.
7,898,812 B2 3/2011 McCoy et al.
7,903,397 B2 3/2011 McCoy
7,916,336 B2 3/2011 Silverbrook et al.
7,931,114 B2 4/2011 LeClear et al.
7,934,958 B2 5/2011 Kendall et al.
7,980,088 B2 7/2011 LeClear et al.
8,008,586 B2 8/2011 Kuehl et al.
8,035,958 B2 10/2011 Kendall et al.
8,040,666 B2 10/2011 McCoy et al.
8,151,016 B2 4/2012 McCoy
8,212,430 B2 7/2012 McCoy
8,314,678 B2 * 11/2012 Ebrom et al. ..... 340/3.1
2001/0017134 A1 8/2001 Bahr
2002/0022991 A1 2/2002 Sharood et al.
2003/0037447 A1 2/2003 Gruber et al.
2003/0154338 A1 8/2003 Boz et al.
2003/0221616 A1 12/2003 Carpenter et al.
2004/0036273 A1 2/2004 McClary
2004/0154318 A1 8/2004 Roh et al.
2004/0202421 A1 10/2004 Iiduka et al.
2005/0011205 A1 1/2005 Holmes et al.
2006/0021659 A1 2/2006 Andersson
2006/0053655 A1 3/2006 Weglin
2006/0118694 A1 6/2006 Lee et al.
2006/0125360 A1 6/2006 Kim et al.
2006/0145576 A1 7/2006 Lee et al.
2006/0168236 A1 7/2006 Higuma et al.
2006/0187080 A1 * 8/2006 Slatter ..... 340/825.22
2007/0086151 A1 4/2007 Oh et al.
2008/0065289 A1 3/2008 Bertosa et al.
2008/0122585 A1 * 5/2008 Castaldo et al. ..... 340/286.01
2008/0125911 A1 * 5/2008 Ebrom et al. ..... 700/275
2008/0164224 A1 7/2008 McCoy et al.
2008/0164225 A1 7/2008 McCoy
2008/0164226 A1 7/2008 McCoy et al.
2008/0164227 A1 7/2008 LeClear et al.
2008/0164796 A1 7/2008 McCoy et al.
2008/0165282 A1 7/2008 Marcy et al.
2008/0165474 A1 7/2008 McCoy et al.
2008/0165475 A1 7/2008 McCoy et al.
2008/0165476 A1 7/2008 McCoy et al.
2008/0165478 A1 7/2008 McCoy
2008/0165505 A1 7/2008 McCoy et al.
2008/0165509 A1 7/2008 Kendall et al.
2008/0165998 A1 7/2008 LeClear et al.
2008/0166895 A1 7/2008 McCoy et al.
2008/0166915 A1 7/2008 Kendall et al.
2008/0168205 A1 7/2008 McCoy et al.
2008/0192411 A1 8/2008 McCoy
2008/0201032 A1 8/2008 Fayyad et al.
2008/0222327 A1 9/2008 McCoy et al.
2008/0231464 A1 9/2008 Lewis et al.
2008/0231764 A1 9/2008 Kendall et al.
2008/0232053 A1 9/2008 Kendall et al.
2008/0247141 A1 10/2008 Kendall et al.
2008/0265191 A1 10/2008 Walborn
2008/0287009 A1 11/2008 McCoy
2009/0009316 A1 1/2009 Kendall et al.
2009/0047824 A1 2/2009 Seibert et al.
2009/0050232 A1 2/2009 Guan et al.
2009/0054804 A1 2/2009 Gharib et al.
2009/0161579 A1 6/2009 Saaranen et al.
2010/0007325 A1 1/2010 Stark
2010/0052866 A1 3/2010 Elferich et al.
2010/0120284 A1 5/2010 Oka et al.
2010/0182753 A1 7/2010 Kendall et al.
2010/0248546 A1 9/2010 McCoy
2010/0281261 A1 11/2010 Razzell
2011/0049308 A1 3/2011 Beaman et al.
2011/0073214 A1 3/2011 Guan et al.
2011/0146328 A1 6/2011 Hendrickson et al.
2011/0146329 A1 6/2011 Kuehl et al.
2011/0146330 A1 6/2011 Kuehl et al.
2011/0146819 A1 6/2011 Hendrickson et al.
2011/0147159 A1 6/2011 Kuehl et al.
2011/0147160 A1 6/2011 Kuehl et al.
2011/0147161 A1 6/2011 Kuehl et al.
2011/0147417 A1 6/2011 Kuehl
2011/0148216 A1 6/2011 McCoy
2011/0148223 A1 6/2011 McCoy
2011/0148649 A1 6/2011 de Cavalcanti et al.
2011/0148650 A1 6/2011 Jenkins et al.
2011/0148651 A1 6/2011 Hendrickson et al.
2011/0149485 A1 6/2011 Kuehl et al.
2011/0152024 A1 6/2011 Kuehl
2011/0153739 A1 6/2011 McCoy
2011/0153821 A1 6/2011 McCoy
2011/0153871 A1 6/2011 Ferragut, II et al.
2011/0153880 A1 6/2011 McCoy

FOREIGN PATENT DOCUMENTS

JP 06310202 A 11/1994
JP 06310204 A 11/1994
JP 06333633 A 12/1994
JP 2007080584 A 3/2007
WO 2007/015274 A1 2/2007

* cited by examiner

SUBSTANCE COMMUNICATING DEVICE WITH ACTIVATABLE CONNECTOR AND CYCLE STRUCTURE

BACKGROUND

Appliances and other useful household equipment are increasingly designed to interact with one another, as well as with a variety of consumer accessory devices. A consumer accessory device may be used, for example, in conjunction with an appliance to enhance or supplement the functionality of the appliance.

BRIEF SUMMARY

The invention relates to substance communicating devices for use in conjunction with an appliance and couplings system for substance communicating devices.

According to one aspect of the invention, a substance communicating device is used in conjunction with an appliance configured to perform a physical cycle of operation on an article using the substance communicating device, the appliance having a first substance service connector component and a first coupling component. The substance communicating device comprises a main body, a substance consumer associated with the main body, a substance line having a first end coupled with the substance consumer and a second end remote from the first end, a second substance service connector component coupled with the second end of the substance line, the second substance service connector component being operably engageable with the first substance service connector component to permit the communication of a substance between the first and second substance service connector components, a second coupling component being configured to engage the first coupling component when the first and second substance service connector components are engaged to selectively permit the communication of the substance between the substance communicating device and the appliance, one of media, an interface for receiving media, and a media access component associated with the main body for providing information related to the substance, and a communication interface for communicating the information to the appliance, wherein the information communicated by the substance communicating device to the appliance is used by the appliance to affect the physical cycle of operation.

According to another aspect of the invention, a consumable holder is used in conjunction with an appliance configured to perform a physical cycle of operation on an article using the consumable holder to provide at least one consumable, the appliance having a switch operably activated by the consumable holder. The consumable holder comprises a main body, a structure for holding a consumable within the main body, a consumable information holder comprising information associated with at least one of the article, the physical cycle of operation, and the consumable, and an actuator operably attached to the main body for operably activating the switch, wherein, when the actuator operably actuates the switch, the appliance reads at least a portion of the information from the consumable information holder and uses the information to affect the cycle of operation on the article.

According to yet another aspect of the invention, an appliance is configured to perform a physical cycle of operation on an article in conjunction with a consumable holder having a structure to hold a consumable and a consumable information holder comprising information associated with at least one of the article, the physical cycle of operation, and the consumable. The appliance comprises a sensor for sensing the presence of the consumable holder, a switch operably connected to the sensor, and a reader operably connected to the switch, wherein the switch is actuated by the sensor when the sensor detects the presence of the consumable holder and wherein the reader reads at least a portion of the information when the switch is actuated.

DETAILED DESCRIPTION

Figure 1:
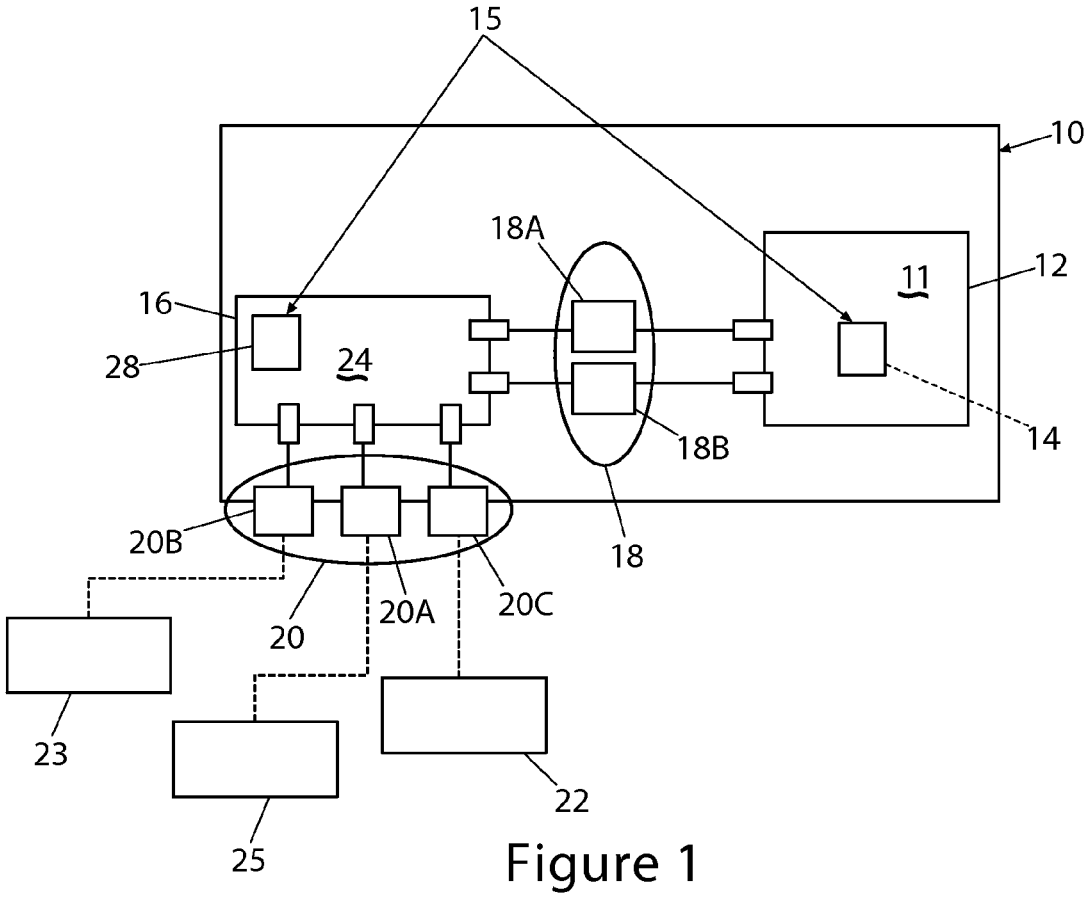
FIG. 1 is a schematic view of an appliance coupled to, and comprising, a substance communicating device.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

The drawings and the following detailed description relate generally relates to substance communicating devices and coupling systems for connecting substance communicating devices. The following definitions apply to terms that may be used in the specification and the claims, unless otherwise noted.

As used herein, a "substance" is a material that may be communicated from one device to another. A substance may include a gas, a liquid, or a solid, or any combination thereof.

Examples of substances include, but are not limited to, liquid soap, powdered soap, compressed air, tablets, caplets, water, ice cubes, and a beverage.

As used herein, "substance communication" or a "substance communication service" is a useful provision of a substance from one device to another device. Communicating a substance includes supplying or receiving a substance. As used herein, communication of substance includes both unidirectional and multi-directional communication between any two devices, either directly or through an adapter, as defined herein. Substance communication may be provided in quanta, such as capsules or other doses of substances, batches of discrete items such as tablets, or consumable components.

The term "consumable" and any variation thereof, as used herein, includes any substance that may be consumed by a host, an accessory device, or a user person, such as food, cosmetics, or medicine. The consumable may, for example, be a substance that is used up and must be replenished for subsequent cycles of operation. For a clothes washer, a consumable might be a detergent and/or a softener. For a clothes dryer, a consumable might be an anti-static cloth. For a cooking or refrigeration appliance, the consumable may actually be the article on which the appliance performs its cycle of operation, as in the case of food, later to be consumed by a person. More specific examples of the use of a consumable in appliances include dispensing additives for clothes washers, clothes dryers, or combination washer/dryer appliances. The additives may include, but are not limited to, normal detergents, gentle detergents, dark clothing detergents, cold water detergents, fabric softeners, chlorine bleaches, color-safe bleaches, and fabric enhancement chemistry. Non-limiting examples of fabric enhancers are additives to provide stain resistance, wrinkle resistance, water repellency, insect repellency, color fastness, fragrances, and anti-microbials. Another example of a consumable contemplated is the filters used by an appliance. Refrigerators, dryers, washers, and dishwashers are all known to use filters that are consumed in the sense that they wear out and must be replaced.

The term "substance consumer" and any variation thereof, as used herein, is any useful device that employs, uses, stores, or dispenses a substance in connection with performing a physical or virtual function. A substance consumer may be, for example, a smart utensil, an appliance, a resource controller, such as a water controller, a dispenser, a filter, a water filter, an air filter, a detergent dispenser, a drink dispenser, a detergent cartridge, or a substance holder, such as a bottle or jug.

The term "substance provider" and any variation thereof, as used herein, is any device that is capable of providing or supplying a substance to another device.

As used herein, the term "substance holder" is anything that holds or contains a substance, which may include, but is not limited to, a container, a dispenser, a cartridge, a dish, a bag, a carton, or a conduit.

As used herein, the term "consumable holder" is any substance holder that holds or contains a consumable.

An attribute of a substance is any information about a substance, including measurable and non-measurable information about the substance that can be stored for later retrieval, including, but not limited to, the physical or chemical properties of the substance, the impact of the substance upon its environment, and the amount of substance.

Non-measurable attributes are attributes about the substance that may be stored with the substance or with the substance holder of the substance, whether the attributes would or would not have been measurable by an appropriate sensor. Examples of non-measurable attributes include quantity of consumable pieces, quantity by volume or by weight, date of manufacture, manufacturer, data about its transit from manufacturer, distributor, market, consumer, data about the temperature during transit, nutritional information like calories, fat grams, daily allowance of essential vitamins and minerals, a list of medical conditions under which the substance should not be consumed, data about the relationship between the substance and known diets and/or known medical conditions, and known reactions to the substance, and the like.

Attributes may be determined by a single measurement or may be derived from multiple measurements, such as measurements of multiple types, measurements taken at multiple locations or measurements taken at multiple times, and may reflect static conditions, such as temperature or quantity, or dynamic conditions such as change, rate of change, or change in rate of change.

Amount attributes are attributes directly reflecting the amount of the substance available for future use, including weight, volume, mass, height, and count. An attribute indicative of the amount is an attribute that may be used or processed to infer or calculate the amount of substance, such as the vapor pressure in a substance holder, the light transmissivity or electrical inductance, capacitance, resistance, reactance, or impedance of the substance. An attribute of the environment is any characteristic of the environment inside of the substance holder, the environment outside of the substance holder, or of the substance holder itself.

As used herein with respect to the attributes of a substance, information or data includes any stored information, such as genealogical and life cycle information relating to the substance, the substance holder, the manufacturer, the environment, and the user(s). Information may be measurable or non-measurable, event based, historical, and/or identifier information.

Since there can be a plurality of substance holders, each with a substance, there may need to be a unique identifier identifying each substance holder or each substance that may be paired with an attribute measurement of a substance so that the value of the measurement can be uniquely identified per its meaning at a later time and by subsequent intelligent processes. The identifier may be associated with the substance, the substance holder, the sensor, or the transmitter and such association may occur at the time of creation or assembly of the components, the time of first adding substance to the substance holder, or the time of introducing the substance holder to a system using a plurality of substance holders. The identifier may also be dynamically generated, for example, from one or more measurable and non-measurable attributes.

Similarly, since there may be a plurality of attributes applicable to a substance, attributes may need to be uniquely identifiable. Attributes may each have a value that is either stored or transmitted, and each respective value may be paired with its attribute identifier so that the value can be uniquely identified per its meaning at a later time and by a subsequent intelligent process. In the simplest case where there is only an amount attribute, the system may assume that all values are amount values with an inherent attribute identifier with the meaning of amount.

As used herein, the terms "substance communication coupling system" or "substance service connector system" refer to any connector system having at least two separate substance communication coupling system components, each of which is associated with a useful device. The substance communication coupling system components cooperate with one another to couple the useful devices to facilitate communication of a substance between the useful devices.

As used herein, the term "substance switch" is any component used to selectively facilitate the communication of a substance between components of a substance coupling system, such as by drawing the components into engagement or by permitting the flow of a substance from one of the components for transfer to the other of the components.

As used herein, the term "switching valve" is any valve used to selectively facilitate the communication of a substance between components of a substance communication coupling system.

As used herein, the terms "substance line" or "substance pathway" refer to a pathway for transferring a substance from one location to another. The substance line may have any of a variety of configurations depending on the type of substance being transferred, including, but not limited to, a pipe, a conduit, a tube, a channel, or fluidically-aligned supply and receiver ports with a gap therebetween.

As used herein, an "electromagnetic service" is electrical power or data. An electromagnetic service may comprise multiple categories of electromagnetic service, such as electrical power and data in a single signal. An electromagnetic service may be provided continuously, for specified times, for specified amounts, or for the duration of certain events, such as the duration of coupling to provide timed dispensing. Alternatively, an electromagnetic service may be provided in quanta, such, as packets of data. Also alternatively, an electromagnetic service may include data encoded into in waves such as light, radio, and sound.

"Wireless" refers to a type of communication in which power and/or data is transferred over a distance without the use of electrical conductors or wires. For example, electromagnetic waves, light waves, or acoustic waves can be used to carry power and/or data over a distance without using electrical conductors or wires.

"Electrical power communication" is the coupling of at least two devices to supply electrical power from at least one of the devices to the other of the devices, such as through directly connected electronic lines or through wireless power communication (also referred to as wireless power transmission). Wireless power communication may include any type of wireless power communication, including, without limitation for illustration purposes, microwave transmission, laser transmission, and magnetic fields. Exemplary categories of power communication include the type of power, e.g. alternating current (also known as AC) or direct current (also known as DC), supplied to the functional device and variations in the characteristics of the power, such as the voltage or current.

"Data communication" is the coupling of at least two devices to transmit data from at least one of the devices to the other of the devices, such as through directly connected electronic lines or through wireless data communication (also referred to as wireless data transmission). The data may be transmitted as a separate signal or embedded in electrical power communication. Wireless data communication may include any type of wireless data communication, including, without limitation for illustration purposes, wireless network technology (a/k/a Wi-Fi), radio transmission, light transmission, and acoustical transmission. Exemplary categories of data communication include encrypted and unencrypted data. Data communication also includes communication for different protocols, including physical layer protocols and software layer protocols. Examples of physical layer protocols are a wired Ethernet and a wireless (using Wi-Fi) network, both of which may support the same data packet structure. Examples of software layer protocol are Zigbee® and Bluetooth®. Data communication may also be completed by way of an analog mechanical transmission means such as by means of fluidic pulses created by positive pressure systems or vacuum systems or by a mechanical logic transfer means, such as the throwing of switches or levers to actuate or transmit information about a control state.

"Communicating" as used herein with respect to an electromagnetic service means supplying or receiving an electromagnetic service. As used herein, communication of electromagnetic service includes both uni-directional and multi-directional communication between any two devices, either directly or through an adapter, as defined herein.

A "substance communicating device" is any substance holder, substance provider or substance consumer which is capable of communicating substance with another device. Examples of a substance communicating device include a dispenser, a filter, a water filter, an air filter, a detergent dispenser, a drink dispenser, a detergent cartridge, a bottle, a jug, a flavoring dispenser, a steam dispenser, a fragrance dispenser, an food ingredient dispenser, a cycle accessory, and a chemistry dispenser.

A "substance communicating system" is any combination of substance communicating devices capable of communicating a substance therebetween.

A "service connector system" is a connector system having at least two separate service connector components, also referred to as service couplers, each associated with a useful device. The service connector components cooperate with one another to couple the useful devices to facilitate communication of a service between the useful devices. A service connector system may carry multiple services. An electromagnetic service connector system, for example, may be associated with or incorporated into a substance connector system or may be independent of a substance connector system but be associated with the same substance holder, substance provider or substance consumer.

A "switched service connector system" is a service connector system having a switching capability in at least one of the service connector components operable to selectively permit the communication of a service between the components of the service connector system.

A "service switch" is any component used to selectively permit the communication of a service between components of a service connector system. A service switch which selectively permits the communication of a substance may be referred to as a "substance switch". A service switch may be associated with more than one type of service. For example, an electromagnetic service switch may be associated with, integrated with, or comprise a substance switch or may be independent of a substance switch.

A "service line" is a pathway for transferring a service from one location to another. The service line may have any of a variety of configurations, including, but not limited to, a pipe, a conduit, a wire, a tube, a channel, and a fiber optic cable. More particularly, to transfer electrical power or data service communication, an electromagnetic service line may include an electrically conductive wire, an optical data cable, or a wireless transmission system.

The terms "provide" and "supply" and any variation thereof, is used herein to denote a source of the substance or an electromagnetic service relative to a device receiving the substance or electromagnetic service. Neither term is limited to the original source of the substance or electromagnetic service. A device that provides or supplies the substance or electromagnetic service may simply be passing on the substance or electromagnetic service from the original source. For example, a device that provides water may pass on water it receives from a residential water supply. However, the device may alternatively or additionally provide another substance that originates with the device, such as an additive stored in a reservoir.

The term "receive" and any variation thereof, is used herein to denote receipt of the substance or an electromagnetic service relative to the device providing the substance or electromagnetic service. The term is not limited to the ultimate consumer of the substance or electromagnetic service. The term "receive" is applicable as well to a device that may simply be passing on the substance or electromagnetic service from the source, such as an appliance, to a device that will consume, as hereinafter defined, the substance or electromagnetic service. The device which receives a substance or electromagnetic service is not necessarily the end consumer of the substance or electromagnetic service.

The term "consume" and any variation thereof, as used herein, denotes the act of employing or dispensing at least a portion of the substance or electromagnetic service received in connection with performing a function.

The term "coupled" and any variation thereof, as used herein, includes any type of connection that permits transfer of a substance or an electromagnetic service between two devices. The term "coupled" does not require a physical connection between the two devices, so long as the coupling permits transfer of a substance or an electromagnetic service. The term "coupled" includes both fixed and removable coupling, as well as both continuous and intermittent coupling.

The term "useful device" and any variation thereof, as used herein, is a device that is capable of performing a useful physical or virtual function either alone or in combination with another device.

As used herein, the term "host" is an apparatus that has a primary function independent of providing or receiving a substance. A host may be a substance provider, a substance consumer, or both. For example, the host may be an appliance and the primary function may be performing a series of steps to conduct a useful cycle of operation. The appliance may be a conventional household appliance, such as a refrigerator performing a cooling cycle or an ice making cycle. Other examples of appliances that may be hosts include, but are not limited to, a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus, or any combination thereof. Alternatively, the host may be a fixture such as a water softener, a water heater, a furnace, pool water treatment equipment, or an HVAC system. The host may be a small device such as a thermostat, a blender, a mixer, a toaster, a coffee maker, a trash compactor, an air purifier, an iron, a vacuum cleaner, or a robot. The host may alternatively comprise a structural feature of a building, such as a wall, a cabinet, or a door. The host may also provide other services, such as electrical power, electronic data, mechanical power, illumination, heat, or sound.

As used herein, the terms "accessory" or an "accessory device" refer to any useful device which may be coupled to a host and communicate a substance to or from the host. An accessory device may be used primarily in conjunction with a host to enhance, supplement the functionality of the host or may have independent functionality and utility. An accessory device may be a substance provider, a substance consumer, or both. Examples of an accessory device include, but are not limited to, a paper product dispenser, a dry goods dispenser, a bottle opener, a liquid dispenser, and a pill dispenser. An accessory or accessory device may also communicate electromagnetic service with the host.

A "proximity target" is any component or device which may be detected when positioned within a predetermined distance of an associated proximity sensor, defined below. A proximity target may be passive, such as visual target or a magnetic target formed of magnetic or magnetic responsive material. Other examples of passive proximity targets may include a conductive component or surface capable of cooperating with a magnetic field, a current, or a voltage provided by a proximity sensor. A proximity target may alternatively be active or powered such as an electromagnet a generator of a magnetic field, a current, a voltage or an acoustic wave. An active proximity target may alternatively provide a powered readable display or dispense a detectable chemical.

A "proximity sensor" is any component or device which may detect an associated proximity target when the proximity target is within a predetermined distance of the proximity sensor. A proximity sensor may detect, for example, a change in an electromagnetic field, an electromagnetic wave, an acoustic wave, a visual target a chemical component, an electrical signal, a change in voltage, a change in current, a change in frequency, a change in resistance, a change in inductance, a change in capacitance, a mechanical signal, a change in pressure, a displacement, a vibration, and the presence of a chemical. A proximity sensor may be active or passive, such as a magnetic sensor of magnetic or magnet responsive material, or may alternatively be active. Examples of active sensors include active magnetic sensors, light sensors, optical sensors, acoustic sensors, electromagnetic sensors, chemical sensors and thermal sensors. Examples of magnetic sensors include magnets and magnetic responsive components. Examples of optical sensors include infrared sensors, photoelectric sensors, fiber optic sensors, photo resistors, photovoltaic sensors, photo diodes and cameras. Examples of electromagnetic sensors include radio receivers, radar sensors, Hall Effect sensors, inductive sensors, capacitive sensors, variable reluctance sensors and eddy current sensors. Examples of acoustic sensors include ultrasonic sensors and microphones. A contact proximity sensor detects a proximity target by touching the proximity target. A contactless proximity sensor detects the proximity target through a wireless or contactless means. For example, magnetic flux can be used as the signaling mechanism between a contactless proximity sensor and a contactless proximity target.

As used herein, the term "proximity system" is a system that uses a "proximity switch" operated by a plurality of "proximity coupling components," each associated with a different parent device, for determining that the parent devices are in proximity with each other. Parent devices are usually paired, examples of which include a service provide and a service consumer, a host and an accessory device, and a host and an adapter. Proximity coupling components may include a proximity target associated with one parent device to actively or passively provide an indication of the presence of the one parent device and a proximity sensor associated with the other parent device that is responsive to the presence of the proximity target to activate the proximity switch. The proximity switch may be used to provide a signal or message indicative of the proximity of two parent devices or may directly or indirectly regulate the flow of a service along a service line. The proximity systems disclosed herein employ contactless proximity systems wherein the proximity target and proximity switch use contactless or wireless means to detect the proximity of the two parent devices. In the context of a proximity switch, a proximity target may be considered a "proximity actuator" in the sense that it causes actuation of the proximity switch.

A "plug" as used herein is a generally male electromagnetic service connection component.

A "receptacle" as used herein is a generally female electromagnetic service connection component.

An "adapter" as used herein is an intermediate device that may be provided between a first and second useful device, such as between a host and an accessory, to facilitate the communication of services between the first and second useful devices. An adapter may receive a service from the first useful device and provide a modified version of the service to the second useful device, for example, by providing an electrical power service using a different voltage or providing a data service using a different data structure or signal type. In some applications, multiple adapters may be interposed between two accessory devices. In other applications, three or more devices may be coupled to a single adapter, such as between a host and two accessories. In some applications, the adapter may itself be an accessory device providing a useful function not provided by the accessory devices coupled to it. An adapter may optionally include a transformative component that transforms a service from a service provider to a different service, which is supplied to a service consumer. This may be useful when the service from the service provider is not compatible with the service consumer. The transformative component can be configured to transform the service into a compatible form for the service consumer. Examples of transformative components are protocol converters, power transformers, or other devices that convert substance, energy, or data from a first form to a second form.

A "software component" as used herein means any software, algorithm, or logic directly or indirectly associated with the operational cycle of an appliance. Generally, all logic provides indirect access to the control of a device, but the meaning can extend to include any non-device oriented software like fragmentation algorithms, algorithms, transfer function evaluations, network traffic handling, user instructions, network authentication services, and the like.

Figure 2:
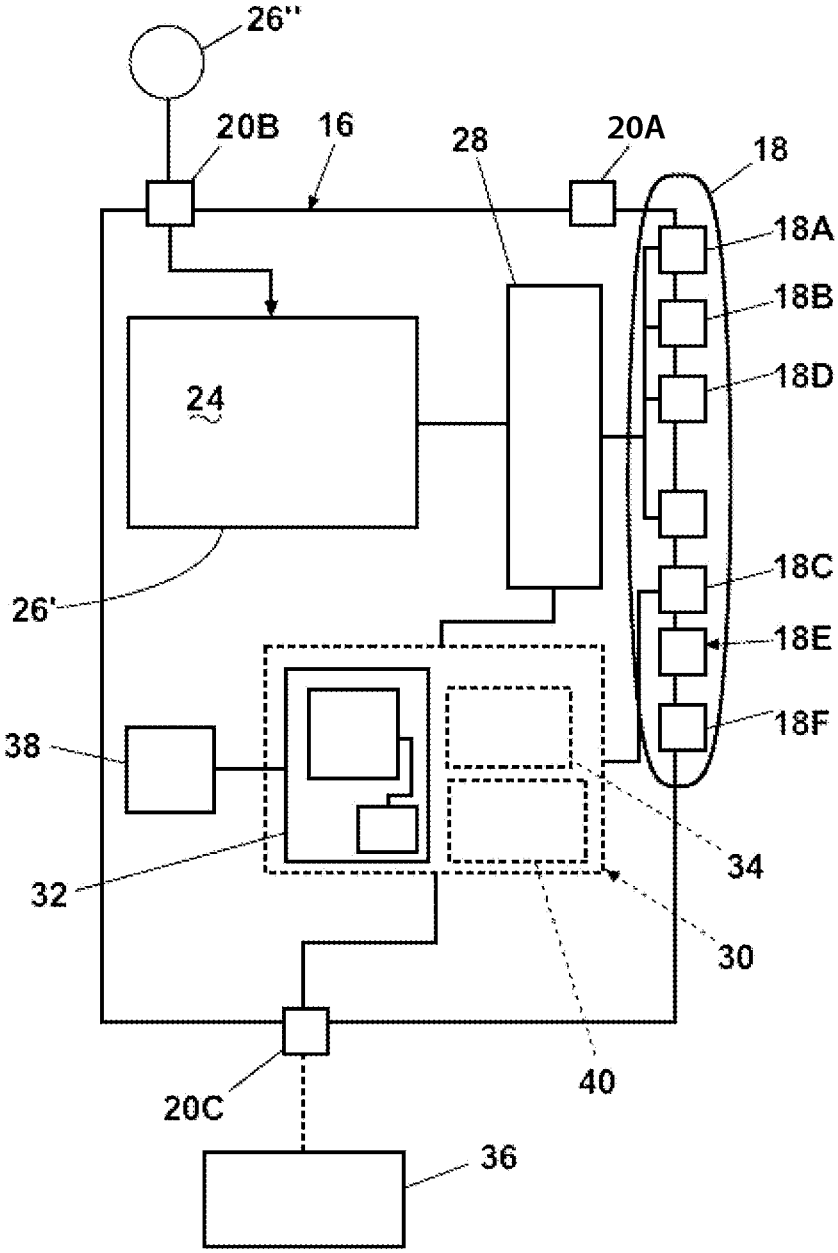
FIG. 2 is a schematic view of the substance communicating device of FIG. 1.

Referring to FIG. 1, a substance handling system 10 is illustrated in schematic form and has a first substance communicating device 12, such as an appliance, with a smart process control apparatus 14, and a second substance communicating device 16, such as a consumable holder. Second substance communicating device 16 may be disposed inside or outside or on the first substance communicating device 12. It may be installed during manufacture and sold with first substance communicating device 12, or it may be made and sold separately as an upgrade or addition. Second substance communicating device 16 may optionally have its own process control apparatus 28, which may be in communication with smart process control apparatus 14 of first substance communicating device 12 or may operate independently. Process control apparatus 14 and 28 may provide at least a portion of the system software architecture and electronics 15 for substance handling system 10. Process control apparatus 14 and 28 may include sensors, actuators, wiring, and other components normally found in an electro-mechanical or mechanical control system. Either process control apparatus 14 or 28 may be able to control itself in limited ways through mechanical techniques. More typically and as illustrated herein, electronics 30, shown in FIG. 2, are connected to the process control apparatus 28 providing additional functionality. Process control apparatus 28 and electronics 30 may be considered in combination as a smart process control apparatus. Smart process control apparatus 14 may also include electronics which interact with the process control apparatus 14 in order to make control decisions based on inputs from sensors or networks and execute those decisions either by network message or the control of actuators within the process control apparatus, but the electronics are not illustrated herein.

First substance communicating device 12 may communicate, through one or more interfaces 18, a substance with second substance communicating device 16 and may as well communicate one or more additional services, such as a data service or a power service. An interface or such as service connector system 18, may include one or more service couplers, such as 18A and 18B for enabling the communication of a one or more services, such as, for example, multiple substance services or a substance service and an electromagnetic service. For example, first substance communicating device 12 may be an automatic clothes washer acting as a host for the second substance communicating device 16, and second substance communicating device 16 may be an additive dispensing accessory capable of dispensing one or more fabric treatment chemicals, such as detergent, bleach or softener, for use by the automatic clothes washer in the processing of a fabric load. As another example, first substance communicating device 12 may be a refrigeration appliance having a water supply and acting as a host for the second substance communicating device 16, and second substance communicating device 16 may be a flavoring dispensing accessory capable of dispensing one or more food flavoring chemicals, such as fruit flavored drink powder, for use by the refrigeration in providing consumers with a flavored drink. As still another example, first substance communicating device 12 may be a refrigeration appliance having a water supply and acting as a host for the second substance communicating device 16, and second substance communicating device 16 may be a drink dispensing accessory holding one or more food flavoring chemicals, such as fruit flavored drink powder, and capable of receiving cooled water from the refrigeration appliance, mixing it with a food flavoring chemical, and dispensing a drink to a consumer. These and other examples are discussed below in more detail.

In general, first substance communicating device 12 may be configured to perform an operation on a physical article 11, such as clothing or food, using a resource such as water, temperature-controlled air (hot or cold), steam, gas, or electricity, provided to first substance communicating device 12 by interfaces, not shown, with a utility, not shown, supplying the resource. Examples of appliances that perform an operation on a physical article include a wide range of device types, including but not limited to, washers, dryers, ovens, ranges, steam cookers, ice makers, refrigerators, drink makers and the like. Articles 11 are the objects upon which a user intends the appliance to perform its cycle of operation. Typical examples as mentioned above would include food and clothing.

Smart process control apparatus 14 is configured to implement and control a cycle comprising at least one operation. Smart process control apparatus 14 may comprise one or more components, not shown, such as electronic control boards, wiring and wiring harnesses, power-supplies, sensors integrated with the electronics as digital or analog inputs, and actuators like valves, relays, heaters, and the like, any or all of which may integrate with the electronics as digital or analog outputs.

Exemplary second substance communicating device 16 is configured to hold, carry, supply, communicate with, or otherwise interact directly with a consumable 24. When performing a cycle of operation on an article 11, first substance communicating device 12 will often use at least one consumable 24. A consumable 24 in one sense comprises a substance, device, or other product that would be at least partially consumed or transformed by first substance communicating device 12 during a cycle of operation on an article 11, such that consumable 24 may be periodically replaced or replenished. The period after which consumable 24 may be replaced or replenished may be, but is not limited to, a single cycle of operation, multiple cycles of operation, an amount of time, or a number of uses. For example, many common washing machines require that a user place a single dose of detergent in a dispenser prior to initiating a cycle of operation. For each subsequent cycle of operation, the user must again place a single dose in the dispenser, as a single dose of detergent is consumed by the washing machine during each cycle of operation.

In some cases, the consumable 24 may be the article 11, on which the first substance communicating device 12 performs the cycle of operation, and the consumable may be subsequently consumed by a user. A consumable 24 may, for example, be anything that would be consumed or otherwise used by a person, such as food, beverages, cosmetics, or medicine. For example, in a cooking or refrigeration appliance, the consumable may be a food item communicated from a dispenser to an appliance, and the cycle of operation performed by the appliance may be heating or cooling the food.

Consumables are to be distinguished from resources, although resources may in some circumstances be "consumed" during a cycle of operation. Resources are commodities that are continuously available to an appliance, and used by the appliance in its cycles of operation on articles 11 that are supplied by external utilities, such as a residential water, power, data or natural gas distribution system, or are available from the ambient environment, such as air. In some cases, a material resource, such as air and water, may also be considered an article 11 as in a refrigerator that chills and dispenses water. That is, water in that instance is a resource (continuously available to the refrigerator from a residential utility), but also an article 11 (intended by the user for the refrigerator to act upon). The cycles of operation performed by the refrigerator would include the chilling and dispensing. Things that hold or supply resources, such as water supply lines or air conduits are not considered consumable holders 16. They would be "resource holders", which may be supplied by resource providers. In a refrigerator, for example, water supplied to the first substance communicating device 12 would be considered a resource and/or an article 11. If flavoring is mixed with the water supplied to first substance communicating device 12, the flavoring may be considered a consumable 24, and whatever holds/supplies the flavoring is then considered to be second substance communicating device 16.

Consumables are also to be distinguished from parts in an appliance, although parts wear out and need to be replaced or replenished as do consumables. Parts are devices, without which a cycle of operation by the appliance or a principal function of the appliance would be hampered. Examples include valves, actuators, switches, tubes, lamps, wiring, motors, pumps, seals, gears and the like. Consumables, on the other hand, are typically not critical to the operation of the appliance, although they provide a benefit to a user of the appliance. An appliance may typically still operate on an article 11 in some fashion without a consumable, though not necessarily as effectively or efficiently.

Second substance communicating device 16 comprises a device that holds or contains consumable 24. Typically, consumable 24 is contained by a consumable holder. In some cases, second substance communicating device 16 may be nested within one or more other consumable holders. For example, a cartridge holding a consumable may be disposed in a dispenser.

In some cases articles 11 on which the appliance operates may not be contained by a consumable holder, and may not be consumables in the sense herein defined. Rather, articles 11 may be enabled to perform at least some of the functionalities of a consumable and/or a substance communicating device. An example of an article 11 with substance communicating device capabilities is a shirt having a bar code thereon containing information that is directly readable by first substance communicating device 12. The bar code may be, for example, on a performance tag. First substance communicating device 12 may use data and/or information represented by the bar code for use in creating, configuring and selecting the cycle of operation of the appliance. The bar code may be read by first substance communicating device 12 while the shirt is being operated contemporaneously with the cycle of operation.

A performance tag is an information holder either integrally formed or selectively attached to an article 11 and adapted to maintain its integrity over the life of the article 11. For example, a performance tag for clothing would be adapted to maintain its integrity throughout the repeated processes of washing in a washing machine appliance, drying in a dryer, being cleaned at a dry cleaners, being ironed, being left in the sun, and being subjected to the impacts sustained during usage. Examples of impacts sustained during usage for a shirt are those that might occur during a soccer match where the shirt impacts the earth and other players at considerable speeds and forces repeatedly. Likewise, performance tags for dishes would be subjected to similar impacts, and similar wash and dry cycles from a dishwasher. Performance tags integrally formed with fabric items might be sewn in, glued in, woven in, stamped on, or printed on during the manufacturing of the article 11 or by a home machine adapted to integrate the article 11 and the tag. Performance tags integrally formed with dishware might be glued, stamped, printed, embossed, cast, molded, or otherwise formed during the manufacturing of the article 11 or by a home machine adapted to integrate the article 11 and the tag. Performance tags that are selectively attached to an article 11 could be attached by sewing, gluing, pining, sticking, printing, embossing, or other like methods in the home environment for articles 11 not specifically adapted for receiving a performance tag. Performance tags are constructed of any suitable material which may be used to hold encoded information about a cycle structure, or information about a consumable, the description of which is contained herein. Examples of materials for holding the information include magnetic strips, bar codes, and images of encoded data including color patterns, shape patterns, plain texts, numeric identifiers, and the like. An appliance having a cycle architecture and being in communication with a performance tag (as for example by using a consumable reader) may optimize the cycle of operation in the appliance for the article 11 in response to the cycle structure, data about a cycle structure, and/or data about a consumable held by the performance tag. Performance tags may either hold information or hold other information about how to find the information. An example of a performance tag that holds other information is a performance tag holding a URL wherein the data returned when invoking the URL is the information. Further, the appliance may alter or optimize the user experience further by providing information on a user interface in response to the cycle structure, data about a cycle structure, and/or data about a consumable.

Other examples further illustrate the foregoing distinctions. Consider using an oven to cook a turkey in a roasting pan where there is a steam dispenser with a basting cartridge for automatic basting. The turkey is the article 11 upon which the appliance (the oven) performs its cycle of operation (cooking). But the turkey is also a consumable in the sense that it is a food item to be consumed by the user. The basting cartridge would be a consumable holder and its contents a consumable. The water used to generate the steam is a resource, making the steam a changed resource. The roasting pan would be a second consumable holder, holding the turkey. The appliance or the roasting pan or some other device (such as a performance tag described below) may also hold information about the turkey or how to cook a turkey or how to cook a turkey in different kinds of ovens. Such information would be considered information about a consumable and information about a cycle structure.

Consider also a powdered detergent box with a performance tag configured to communicate with an appliance contemporaneously with the dispensing of the detergent to a washer. The washer is the appliance, the detergent is a consumable, and the box is a consumable holder. The performance tag may hold information about the chemistry of the powder, information about cycle structures, and data about cycle structures wherein the information and data are associated with other information comprising appliance types, fabric types, stain types, and the like so that the data and information may be used alone or combined with the other information to create a cycle of operation in response to the data and the information and in response to the user and the user preferences about the cycle of operation, the data, the information, and the other information.

Consider also a detergent pellet with an etched or embossed or imprinted cycle structure enabled to communicate with an appliance contemporaneously with being introduced into a washing machine before or during a wash cycle. Here, the washing machine is an appliance and the detergent pellet is a consumable. There is no separate consumable holder. The cycle structure is intended to effect the cycle of operation (washing). Consider also a detergent pellet having a data pod. The detergent pellet is a consumable, but the data pod is a form of performance tag that could communicate with an appliance contemporaneously with being introduced into the use environment for the purpose of effecting the cycle of operation.

A consumable or a consumable holder or a performance tag or data pod or anything that may hold and convey information (consumable information holder) might comprise one or more cycle structures. A first cycle structure may be associated with a first appliance or first appliance type and a second cycle structure may be associated with a second appliance or a second appliance type such that the appropriate cycle structures are introduced to the appropriate appliance or appliance type when the consumable or consumable holder is in useful communication with the appliances. For example, a frozen food (a consumable) or a package of frozen food (a consumable holder) might have cycle instructions for freezing, defrosting, or preserving cycles in a refrigerator or freezer appliance, and also might have cycle instructions for defrosting, cooking, or warming cycles for a cooking appliance like an oven or microwave.

A consumable information holder may comprise one or more user interface data sets, with or without cycle structures, which may be communicated to a user interface, such as might be on the appliance. User interface data is considered to include anything that may be rendered to be responsive to a user's senses, such as visual displays, audible sounds, and tactile displays. A first user interface data set may be associated with a first appliance or first appliance type and a second user interface data set may be associated with a second appliance or a second appliance type such that the appropriate user interface data are conveyed to a user interface associated with the appropriate appliance or appliance type when the consumable or consumable holder is in useful communication with the appliances. For example, a frozen food (a consumable) or a package of frozen food (a consumable holder) might convey to a refrigerator an expiration date to be rendered on a user interface on the refrigerator. The frozen food or its package might also convey to an oven serving suggestions to be rendered on a user interface on the oven.

Consumables, consumable holders, performance tags, data pods and the like (consumable information holders) may be enabled not only to provide data, but also may be configured to receive and store information associated with the consumable. Exemplary information includes data about a consumable, a cycle structure, data about a cycle structure, tracking the number of times a shirt or a dish is washed, the number of cycles and the parameters thereof which have been executed by or in combination with an appliance and consumable holder. It may also include the types of consumables introduced into the use environment, information entered into an appliance user interface including cycle selections, usage patterns, user information, user identification, other data associated with the cycle of operation of an appliance, and any data held by a data source in communication with the holder, tag, or pod which either the data source writes to the holder, tag, or pod, or any data or the holder, tag, and pod reads from the data source. Such information may be sequentially added to a database on the consumable information holder for later retrieval. For example, a shirt with a performance tag may keep data about how many times it has been washed, about different wash cycles it has been through, and the specific machines it has been washed in.

More specific examples of consumables 24 for use with or by substance communicating device 12 include dispensing additives for laundry washers, dryers, or combination washer/dryer appliances. Other additive examples are provided in the definition of consumables above.

An additive dispenser in this case would be second substance communicating device 16 and may be a single load dispenser that dispenses all of additive contained therein during a single cycle or a bulk dispenser that dispenses only some of the additive contained therein during a single cycle. An appliance comprising a bulk dispenser may meter and dispense the correct amount of additive for each particular load and provide information to the user regarding the remaining amount of additive in the bulk dispenser after dispensing.

Because each additive may have different parameters associated with its use, information about each consumable may be provided with each consumable 24. This information may be provided on the packaging of consumable 24 (i.e. the consumable holder), in consumable 24, or by any other suitable means (performance tag, data pod, user interface, etc.). For example, different additives may have different concentrations, and the amount of a given additive needed for a particular load will vary depending on the concentration of that additive. The amount of a particular additive needed to complete a cycle of operation will also depend on the amount and type of laundry being treated, as well as the condition of the laundry (e.g. soil and stain level). The amount, type, and condition of the laundry may be determined utilizing information supplied by the user, information gathered by sensors associated with the appliance, or information otherwise obtained during the operation of the first substance communicating device 12.

Additional information provided with the consumable may also be used to tailor the cycle of operation to that consumable 24. In a laundry application, the additive will have to be dispensed at the right time during the cycle, such as before, during, or after wash, rinse, spin, or drying. Particular additives may also require that they are dispensed under certain conditions, such as at a given water temperature or air temperature. Additionally, particular additives might require at least one additional step in a cycle for optimal performance. For example, the presence of a particular additive might require that the cycle structure be augmented by inserting an additional ordered collection of steps such as filling at a new temperatures to a new level after spinning, then soaking for an amount of time, then draining, then spinning for a new amount of time at a new spin speed between the original step in the cycle and the last step in the cycle.

The smart process control apparatus 14 or electronics 30 may determine parameters to be used for the cycle of operation or the structure of the appropriate cycle of operation or changes to an existing cycle of operation for different operations based on the information provided with consumable 24, user input, and information obtained by sensors associated with first substance communicating device 12. Exemplary types and sources of information are found in the following table:

| Information provided from the consumable or consumable holder | Information provided by the user | Information provided by appliance sensors |
|---|---|---|
| New order collection of cycle steps, actions for each step, a plurality of transition logic expressions for each step, and the relationships between steps, actions, and logic expressions | Fabric type | Soil level |
| Additive type | Desired cycle | Load weight |
| When in cycle to dispense | Fabric type | Load absorption |
| Any special cycle parameters | Load size | Additive remaining in dispenser |
| Amount to dispense for a standard load | Fabric condition (soil level, stains, etc.) | Soil level |
| Special dispenser maintenance considerations | Dispensing compartment used | None |

Another example of a consumable includes filters used by first substance communicating device 12. Refrigerators, dryers, washers, and dishwashers are all known to use filters that are consumed in the sense that they must be replaced after a certain amount of time or usage due to wear and dirtying of the filter. Filters, in particular, depending on the embodiment may be construed as a consumable, a consumable holder, or both. For example, if there is a filter assembly holding a filtering material, then the filter assembly may be considered a consumable holder and the filtering material may be considered a consumable because it is disposed of after it usability is consumed; its life and the life of the consumable holder are significantly different. On the other hand, the filter assembly and the filter material may be integrally formed and introduced and removed from the use environment as a unit. In this case, the assembly and the filter material would be considered both a consumable holder and consumable because the assembly and the filter material comprise functionality and attributes of both consumable holders and consumables.

Consumables may also include food, as mentioned above, and articles of clothing. Such consumables may or may not be contained by a consumable holder. However, non-contained consumables may still have consumable holder functionality in that they may comprise information about the consumable that is retrievable by the appliance. For example, a food item may carry information about itself that is contained in edible ink printed on the surface of the food item.

Returning to the drawings, service connector system 18 may be an internal or external interface configured to couple second substance communicating device 16 and first substance communicating device 12. Substance handling system 10 may also be provided with an interface 20 for removably connecting one or more additional accessory devices 22, 23 or 25. Interface 20 couples accessory devices 22, 23 or 25 to second substance communicating device 16, but it will be appreciated that such an interface may alternatively or additionally be provided on first substance communicating device 12.

Interface 20 may include one or more service couplers, such as 20A, 20B and 20C for enabling the communication of a one or more services provided by any other source or device, such as accessory devices 22, 23 and 25, that may be advantageously used with the first substance communicating device 12 and/or second substance communicating device 16. One or more of the accessory devices 22, 23 and 25 may have a process control apparatus, not shown, that may interact with or become a part of system architecture and electronics 15 when coupled with substance handling system 10.

Accessory device 22 may, for example, comprise a power source, a consumable source, a consumable dispenser, a consumable reader, a data processor, or a component which may facilitate engagement or interaction with second substance communicating device 16. In another example, second substance communicating device 16 may act as an adapter between first substance communicating device 12 and accessory device 22 for communicating a service therebetween. Accessory device 23 may be a consumable reader, including a bar code or RFID tag reader and a microprocessor. Alternatively, a consumable reader may be incorporated into first substance communicating device 12 or second substance communicating device 16 and accessory device 23 may be a sensor for the consumable reader. Accessory device 25 may be a bulk source of consumable 24, such as a large bottle of detergent which provides second substance communicating device 16 with a replenished supply of consumable 24 as second substance communicating device 16 dispenses a dose of substance 24 into first substance communicating device 12.

System architecture and electronics 15 may include software, not shown, enabling at least one of first substance communicating device 12, second substance communicating device 16, or accessory devices 22, 23 or 25 to discover other devices using network messages.

Referring now to FIG. 2, illustrating schematically more details of second substance communicating device 16, service connector system 18 may include a plurality of service couplers 18A-F. Each service coupler may communicate one or more services and may enable one or more functions. For example, service coupler 18A may communicate a consumable 24 to second substance communicating device 16, service coupler 18B may communicate a non-consumable substance to second substance communicating device 16, service coupler 18C may communicate the non-consumable substance back to first substance communicating device 12, service coupler 18D may communicate data between first substance communicating device 12 and second substance communicating device 16, service coupler 18E may couple two power contacts of second substance communicating device 16 to two power contacts of first substance communicating device 12, and service coupler 18F may couple a power takeoff associated with first substance communicating device 12 with a mechanical powered device associated with second substance communicating device 16. Any service communicated through service couplers 18A-18F may be consumed, returned, stored, or passed on to a third device by the device receiving the service. The service may be used to trigger or enable an event, such as to trigger a dispensing event, modify data, or affect a cycle of operation. For example, a mechanical, electrical or data service from first substance communicating device 12 may trigger an actuator in second substance communicating device 16. A substance communicated across a service connector system may be a consumable, a resource or non-consumable substance. Substance and mechanical communication between second substance communicating device 16 and first substance communicating device 12 will normally require a physical coupling. Data, power, illumination, thermal or acoustic communication may require a physical coupling or may occur through a contactless or wireless connection.

In one embodiment, a changed substance is communicated through service coupler 18F. The substance may initially be a resource or a consumable and will have been changed by one of the substance communicating devices prior to being communicated to the other substance communicating device. A changed substance may be one whose properties have been changed by a chemical, thermal, electrical, or other type of process. For example a changed substance may be one that has been heated, cleaned, cooled, mixed with a consumable, or generally treated in such a way that it has at least one property with a different value.

As mentioned above, service coupler 18E may include a power service connector component. A power service connector component may deliver power to a second substance communicating device 16 or it may deliver power to smart process control apparatus 14. The power may be conventional AC at 110 V, DC at 12 V, or another type or amount, such as the power that is transmitted by a USB connection. In some cases, a service connector component may function as both a data and a power source.

Second substance communicating device 16 has an internal source 26' and/or an external source 26" of a consumable 24. If second substance communicating device 16 has the optional process control apparatus 28, as shown in FIG. 2, the process control apparatus 28 may be used for controlling the dispensing or communication of consumable 24 from source 26', or 26".

Second substance communicating device 16 may have components of system software architecture and electronics 15 shown in FIG. 1. For example, as shown in FIG. 2, second substance communicating device 16 may further comprise electronics 30 configured for communication through service coupler 20C with an accessory device such as a consumables reader 36, or through service connector system 18 with smart process control apparatus 14 of first substance communicating device 12 (see FIG. 1). Electronics 30 may affect the operation of the first substance communicating device 12 by communicating with appliance smart process control apparatus 14 when second substance communicating device 16 is in communication with the first substance communicating device 12 through service coupler 18C. Electronics 30 may be configured to deliver a cycle of operation to first substance communicating device 12. Additionally, electronics 30 may be coupled to the process control apparatus 28 of the second substance communicating device 16 to provide additional functionality to substance handling system 10.

Alternatively, electronics 30 may communicate with portions of system software architecture and electronics 15 in the first substance communicating device for the purposes of observing the cycle of operation and modifying the cycle of operation. Electronics 30 may observe the cycle of operation using an appropriate data collection scheme, such as those disclosed in PCT Application Serial Number US2006/022430, filed 8 Jun. 2006, entitled "Software Architecture System and Method of Communication with, and Management of, at least One Component within a Household Appliance," supported by software of the system software architecture and electronics 15. These data collection schemes include, but are not limited to: requesting data from system software architecture and electronics 15, such as data stored in a data storage device 34 or data processed by the software architecture received from the first substance communicating device 12 such as unsolicited events from the cycle of operation; and or creating new events that may be received by communicating with a software architecture having a data acquisition (DAQ), not shown, as disclosed and defined in the above referenced PCT patent application and specifying the events to the DAQ for creation by the DAQ.

In addition, electronics 30 may alter a cycle of operation of one of the devices 12, 16, in response to the observations, such as in the manner described in the above referenced PCT patent application. In a first embodiment, electronics 30 may alter the cycle of operation by requesting software in the system software architecture and electronics 15 so that the smart process control apparatus 14 will enter an alternate operating mode enabling electronics 30 to directly control, partially or wholly, the cycle of operation. In a second embodiment, electronics 30 may alter the cycle of operation by making specific requests to system software architecture and electronics 15. In a third embodiment, the electronics may selectively alter the cycle structure using any of the techniques described herein. Electronics 30 may include a controller 32 and software architecture, not shown, similar to system software architecture and electronics 15 of first substance communicating device 12 and/or a software architecture driver (not shown). Electronics 30 may be powered by second substance communicating device 16 or via connection to the first substance communicating device 12. Electronics 30 may further comprise a client 40. Client 40 may comprise a plurality of arbitrary software components, system software architecture and electronics 15, not shown, an instance of system software architecture and electronics 15, a converter, and any other software and data storage and data access functionality.

It will be appreciated that some or all of the above described components of the electronics 30 may alternatively reside in the first substance communicating device 12 in any accessory or other device in data communication with the second substance communicating device.

The second substance communicating device 16 may also have a consumable reader 36, coupled to second substance communicating device 16 by service coupler 20C. In this case, consumable reader 36 is communicatively coupled to the controller 32 and to system software architecture and electronics 15. This enables information about consumable 24 and/or about second substance communicating device 16 to be read from a source of information and transferred into the memory of controller 32 or into the memory of at least one control board within the smart process control apparatus 14 wherein the transferring may be accomplished using system software architecture and electronics 15.

Second substance communicating device 16 may have at least one sensor 38 to sense one or more attributes of a consumable 24 and/or its source 26' or 26". Attributes may include, but are not limited to, amount, brand, type, composition, structural form, expiration date, dispensing properties, nutritional information, temperature, pressure, and concentration. To store and inventory such data, second substance communicating device 16 may utilize controller 32. Such information or data may also be conveyed to and/or presented at a user interface in second substance communicating device 16 or first substance communicating device 12.

Process control apparatus 28 of second substance communicating device 16 may be configured to detect functionalities of first substance communicating device 12, modify functionalities of first substance communicating device 12, be controlled by first substance communicating device 12, be controlled by electronics 30, or otherwise exchange data with the smart process control apparatus 14 of first substance communicating device 12 either directly through one or more coupling points of service connector system 18 or indirectly through electronics 30 coupled to the first substance communicating device 12 through service coupler 18C. Process control apparatus 28 may be used for the transmission, dispensing, supplying, or usage of at least one consumable 24 by responding to control signals resulting in the actuating of a mechanical part, such as a valve, conduit, solenoid, sensor, actuator, spring, transmission, motor, or gear, not shown. Additionally, process control apparatus 28 may be configured to modify properties of one or more consumables or resources such as temperature or a chemical property. For example, temperature could be raised by actuating a heater, and chemical properties might be changed by controlling a mixture of at least two consumables and/or resources by using a motor and an auger. Additional auxiliary functionalities not directly related to consumables 24 may be enabled by process control apparatus 28. Process control apparatus 28 may optionally include a mechanism to affect the use of a resource, such as an actuator for a valve.

Second substance communicating device 16 may receive resources from first substance communicating device 12, act on the resources, and return the modified resources to the appliance. For example, in a washing machine or dishwasher, second substance communicating device 16 may receive water from first substance communicating device 12 and return that water to first substance communicating device 12 as grey water or as water mixed with detergent. In this instance, detergent would be consumable 24. Second substance communicating device 16 may thus export modified consumables 24 which have either been operated on by second substance communicating device 16 or that have been operated on by the introduction of at least one resource. Second substance communicating device 16 may also dispense consumable 24 directly to first substance communicating device 12.

Client 40 in electronics 30 may contain a data set linking the model of first substance communicating device 12 or some other functional identifier such as a class identification, application programming interface (API) identification, type, and/or version to the consumables 24 that second substance communicating device 16 may contain. The data set may further link any of these attributes to a plurality of cycles of operation for first substance communicating device 12. The data set may also link cycle modification or cycle operation data or cycle structure data or data for response to a query message to various combinations of appliances 12, consumables 24, and selected cycles. The data set may alternatively be in first substance communicating device 12. The data in the data set may be modified by a message sent by one of the constituents of the substance handling system 10, such as second substance communicating device 16, consumable 24, consumable reader 36, or accessory devices 22, 23, 25.

Figure 3:
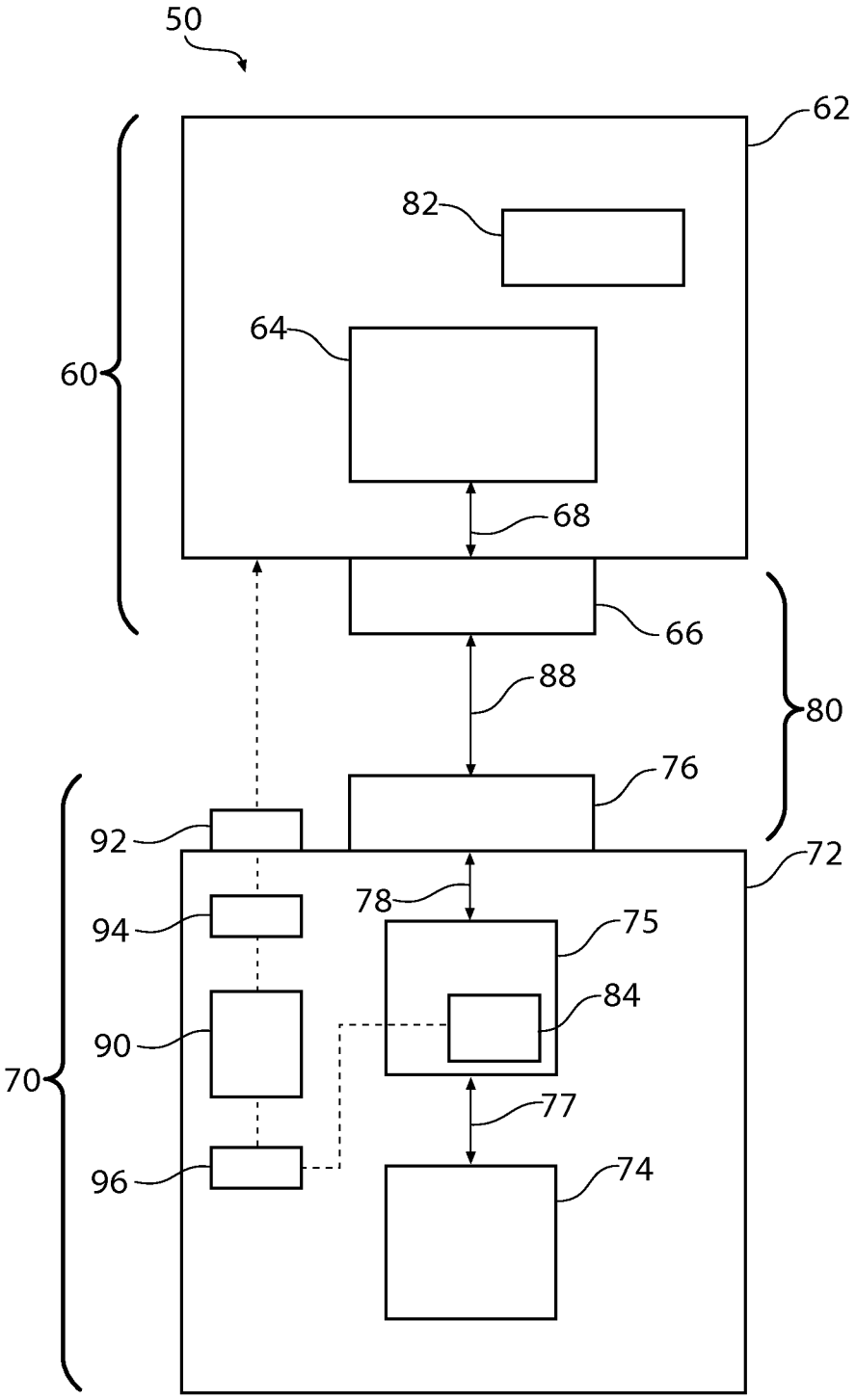
FIG. 3 is a schematic illustration showing a substance coupler.

Turning now to FIG. 3, a service coupler 50, providing one possible configuration for at least one of service coupler 18A-18F (see FIG. 2) or 20A-20C (see FIG. 1) is schematically illustrated. A first substance communicating device 60 is connectable to a second substance communicating device 70 for selectively communicating a substance therebetween. First substance communicating device 60 may comprise a host 62 having a substance consumer 64 connected to a first substance service connector component, such as a plug 66, by means of a substance line 68. Second substance communicating device 70 may comprise an accessory device 72 comprising a substance holder having a substance source 74 connected to a second service connector component, such as a receptacle 76, by substance lines 77 and 78 and regulated by a flow regulating component, such as a switching valve 75

A substance communication service connector component 80 includes plug 66 and receptacle 76, which are selectively interengageable, as indicated by arrow 88. A wireless proximity target 82 associated with host 62 and a proximity switch 84 associated with accessory device 72 and including a proximity sensor, not shown, for detecting the presence of proximity target 82. Proximity switch 84 is operable to selectively activate switching valve 75 when plug 66 and receptacle 76 are engaged, as determined by the proximity sensor, to permit the flow of the substance from substance provider 74, along substance lines 77 and 78, to receptacle 76, to plug 66, and subsequently along substance line 68 to substance consumer 64.

It will be appreciated that while accessory device 72 is illustrated as including a substance provider and host 62 is illustrated as including a substance consumer, host 62 may alternatively or additionally include a substance provider and accessory device 72 may alternatively or additionally include a substance consumer. It will further be appreciated that while plug 66 is illustrated as being associated with substance consumer 64 and receptacle 76 is illustrated as being associated with substance provider 74, it is contemplated that plug 66 and receptacle 76 may be male or female connector components so long as the components are capable of interengaging to permit the transfer of substance therebetween.

The second substance communicating device 70 can further comprise a media component 90 for providing information related to the substance. The media component 90 can comprise media, an interface for receiving media, or a media access component. The media can include a consumable information holder. Consumable information holders and the information that can be provided by consumable information holders are described in more detail below. Other examples of media include, but are not limited to, a computer memory, a flash memory, a USB flash drive, an SD Card, material with a printed bar code, and material with a coded image. One example of an interface of receiving media is an electrical connector. Examples of media access components include, but are not limited to, a computer chip, a wireless radio, a transceiver, and an optocoupler.

The second substance communicating device 70 can further comprise a communication interface 92 for communication information provided by the media component 90 to the first substance communicating device 60. The first substance communicating device 60 can use the information to affect a physical cycle of operation performed by the first substance communicating device 60, as in the case of the first substance communicating device 60 being an appliance. Some examples of the communication interface 92 are an electrical connector, an optocoupler, an antenna, an LED, a light pipe, and any device which can propagate or receive a wave, pulse, or signal. While illustrated as a separate component, the communication interface 92 can be integrated with the receptacle 76.

The second substance communicating device 70 can further comprise communication component 94 operably coupled to the communication interface 92 via a communication pathway. Some examples of the communication component 94 are a computer chip, a wireless radio, a transceiver, and an optocoupler.

The information can selectively be communicated to the first substance communicating device 60 when the plug 66 and receptacle 76 are engaged. The second substance communicating device 70 can optionally comprise a signal generator 96 that generates a signal when the plug 66 and receptacle 76 are engaged, wherein the communication component 94 detects the signal, and, in response to the detection of the signal, enables communication with the first substance communicating device 60 via the communication pathway and the communication interface 94. The signal generator 96 can be operably coupled to or integrated with the proximity switch 84, such that when the proximity switch 84 is actuated, the signal generator 96 generates the signal.

In another embodiment, the communication component 94 can optionally comprise a code, wherein the code is sent by the communication component 94 to the first substance communicating device 60 via the communication pathway and the communication interface 92 when the plug 66 and receptacle 76 are engaged.

In another embodiment, the communication component 94 can optionally comprise logic that determines that the plug 66 and receptacle 76 are engaged by observing the communication between the communication component 94 and the first substance communicating device 60 and issues a signal to the switching valve 75 to permit the flow of substance in response to the determination. The logic can, for example, comprise at least one of a digital logic circuit, software, an electronic circuit, and an analog logic circuit.

Figure 4:
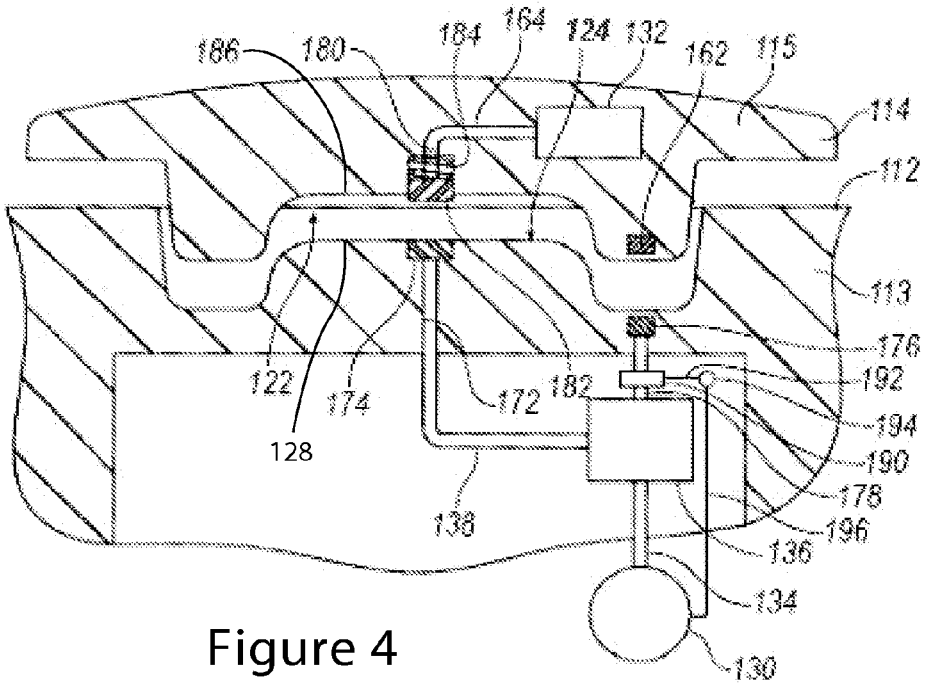
FIG. 4 is a partial cross-sectional view of a proximity sensor enabled substance communication coupling system, showing a first substance communication device positioned for engagement with a second substance communication device.
Figure 5:
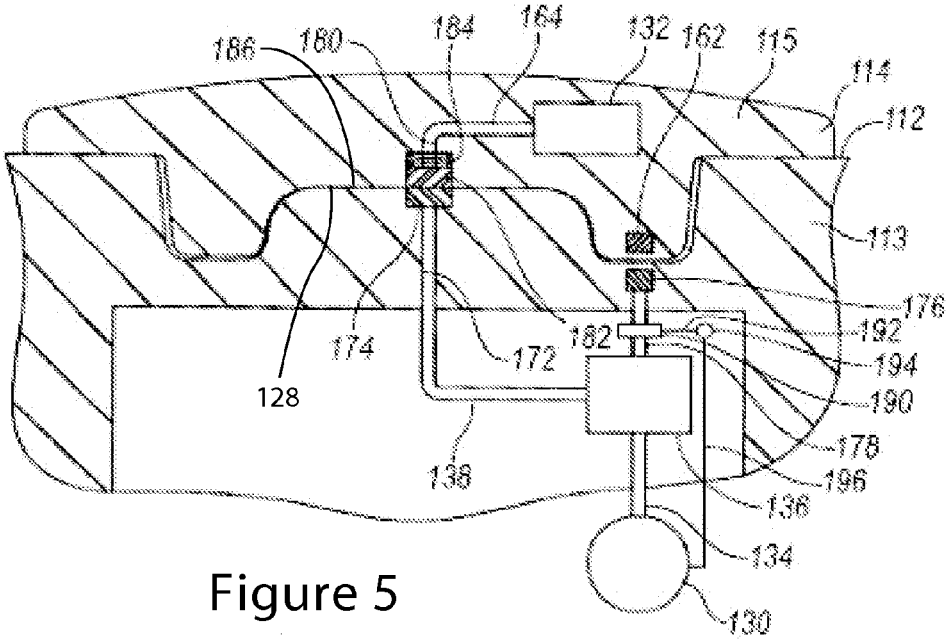
FIG. 5 is a partial cross-sectional view similar to FIG. 4, showing the first substance communication device engaged with the second substance communication device.

Referring to FIGS. 4 and 5, a more specific example of a substance communicating system is illustrated and includes a first substance communicating device 112 having a first substance connector component 124 and a second substance communicating device 114 having a second substance connector component 122. In the example illustrated, one of the substance communicating devices may, for example, be a host appliance and the other substance communicating device may be an accessory. One of the substance communicating devices may be a substance provider and the other may be a substance consumer.

First substance connector component 124 and second substance connector component 122 have complementary configurations that enable the substance connector components to be coupled to one another, thereby establishing a substance pathway over which desired substances may be transferred between first substance communicating device 112 and second substance communicating device 114. Together, first substance connector component 124 and second substance connector component 122 comprise a substance communication coupling system. Substance connector components 122 and 124 may be integrally formed with second substance communicating device 114 and first substance communicating device 112, respectively, or may be an add-on devices.

First substance communicating device 112 may include a substance providing device 130 connected by a first substance line 134 to a substance flow regulating component 136, which may be, but is not limited to, a switching valve or a pump. A second substance line 138 extends from substance flow regulating component 136 through an aperture 172 in a housing 113 of the first substance communicating device 112 to a first interface 174. It will be appreciated that the precise configuration of interface 174 may vary depending, at least in part, on the substance being provided by substance lines 134 and 138. Substance flow regulating component 136 may be associated with a proximity sensor 176 adapted to activate substance flow regulating component 136 to selectively permit the flow of a substance from first substance line 134 to second substance line 138 in response to the detection of an appropriate proximity target. Proximity sensor 176 may be configured, for example, to sense a magnetic field, an electromagnetic or acoustic wave, a visual target, a temperature or a chemical. Proximity sensor 176 is connected to substance flow regulating component 136 by a line 178 to communicate the detection of an appropriate proximity target to substance flow regulating component 136. The communication along line 178 may be, for example, by means of an electrical signal, an acoustic or electromagnetic wave, or a physical displacement of a linking member.

Second substance communicating device 114 may be provided with a substance consuming device 132 connected by a substance line 164 through a passageway 180 in a housing 115 of the second substance communicating device 114 to a second interface or service connector component 182 engageable with first interface 174. Second substance communicating device 114 may further be provided with a biasing member, such as a spring 184, biasing second interface or service connector component 182 partially through passage 180. Second substance communicating device 114 is further provided with a proximity target 162 chosen for cooperation with proximity sensor 176.

Coupling second substance communicating device 114 to first substance communicating device 112 can be accomplished by positioning second substance communicating device 114 adjacent first substance communicating device 112 in such a manner that second substance connector component 122 is generally aligned with first substance connector component 124, as shown in FIG. 4. First substance connector component 124 and second substance connector component 122 may include various features to facilitate the coupling of second substance communicating device 114 to first substance communicating device 112. For example, first substance connector component 124 may include a raised boss 128 that can engage a corresponding recess 186 of second substance connector component 122.

With substance connector components 124 and 122 engaged, as shown in FIG. 5, proximity target 162 comes into the range of proximity sensor 176 and activates substance flow regulating component 136 to switch on the flow of substance from substance providing device 130 to substance consuming device 132. Spring 184 limits the movement of second interface or service connector component 182 against first interface 174 to facilitate a reliable seal between interfaces 174 and 182. Similarly, detaching second substance connector component 122 from first substance connector component 124 displaces proximity target 162 away from proximity sensor 176, thus signaling substance flow regulating component 136 to switch off the flow. Spring 184 may provide continued engagement of second interface or service connector component 182 with first interface 174 to accommodate a small amount of relative displacement between substance connector components 124 and 122.

Alternatively or in addition to substance flow regulating component 136, an additional switch, such as electrical switch 190, may also be associated with a proximity sensor 176. Electrical switch 190 may be connected by electrical lines 192 to a power supply 194, and may be adapted to control the substance flow regulating component 136 or permit the operation of other features of the first substance communicating device 112. For example, power supply 194 may be connected by electrical lines 196 to substance providing device 130, and electrical switch 190 may selectively open an electrical valve or operate a pump (not shown) associated with substance providing device 130.

Proximity sensor 176 and substance flow regulating component 136 may be unpowered or may rely on a secondary power supply 194 for power. Substance flow regulating component 136 may also be activated or powered by the presence or absence of a static magnetic field. For example, line 178 attached to proximity sensor 176 may operate as a plunger for activating substance flow regulating component 136. In this arrangement, at least one of proximity target 162 and proximity sensor 176 may be formed of a magnetic material. When proximity target 162 is positioned in the vicinity of proximity sensor 176, such as may occur when attaching second substance communicating device 114 to first substance communicating device 112, proximity sensor 176 will be displaced toward proximity target 162 due to the magnetic attraction of the two components. This in turn will withdraw line 178 and activate substance flow regulating component 136. Line 178 may be biased toward substance flow regulating component 136, which will enable substance flow regulating component 136 to be deactivated when second substance communicating device 114 is detached from first substance communicating device 112.

Figure 6:
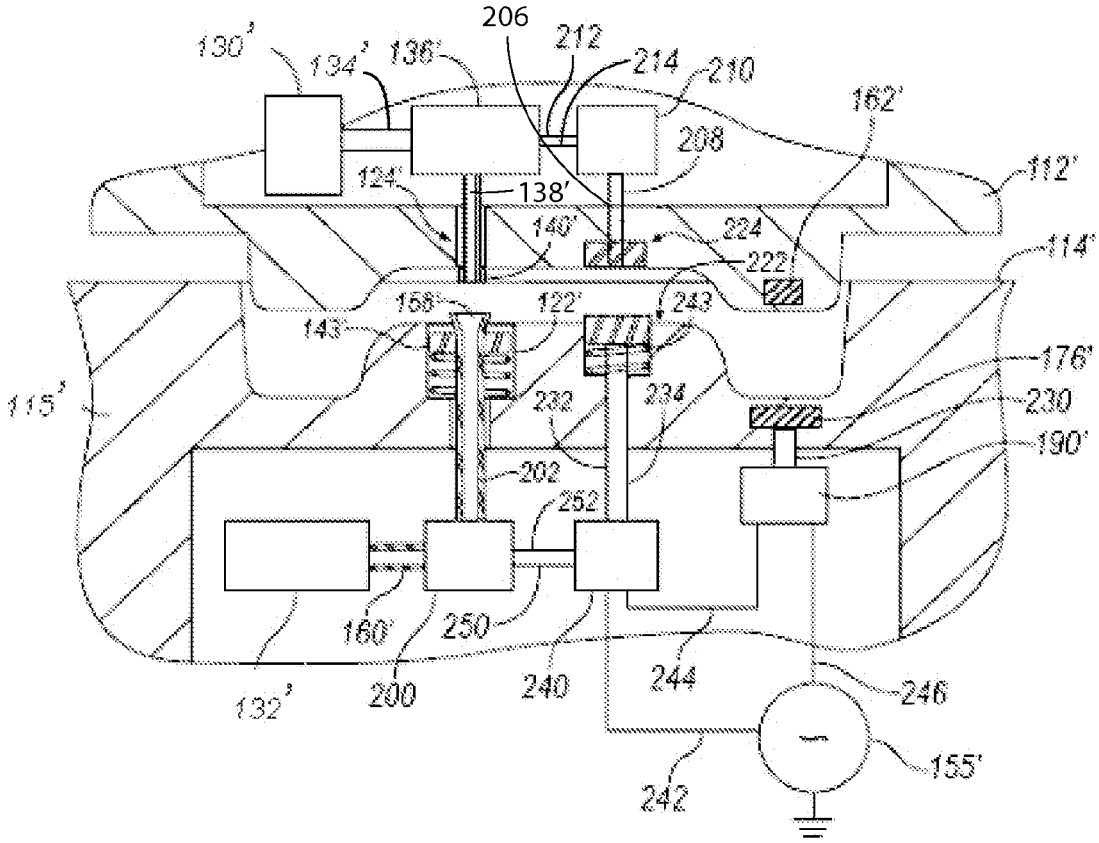
FIG. 6 is a partial cross-sectional view of an alternate proximity sensor energized substance communication coupling system showing a first substance communication device positioned for engagement with a second substance communication device.

Referring now to FIG. 6, an alternative substance communicating system is illustrated, and includes a first substance communicating device 112' and a second substance communicating device 114'. First substance communicating device 112' and second substance communicating device 114' each have two service connector components. A proximity sensor 176' and a power supply 155' are in the second substance communicating device 114', whereas the proximity sensor 176 and power supply 194 were in the first substance communicating device 112 in the previously described embodiment for FIGS. 4 and 5. This configuration may be used, for example, when the second substance communicating device 114' is an appliance that is connected to a residential power supply and the first substance communicating device 112' is an accessory device without an independent source of power.

To avoid confusion, please note that the second substance communicating device 114' is a substance consumer and is shown below the first substance communicating device 112', which is a substance provider, in FIG. 6, which the reverse of the configuration shown in FIGS. 4 and 5.

First substance communicating device 112' has a substance provider 130' connected by a substance line 134' to a first flow regulating device 136', such as a switching valve or a pump, not shown, to a substance line 138' terminating in a receptacle 140'. Second substance communicating device 114' has a substance consuming device 132' connected by a substance line 160' to a second flow regulating device 200, such as switching valve or a pump, connected in turn to a substance line 202 terminating in a plug 158' engageable with receptacle 140'.

Second substance communicating device 114' further has a proximity sensor 176' having a line 230, such as a power line, a data line, a plunger or other device to communicate with proximity switch 190'. First substance communicating device 112' has a proximity target 162' engageable with proximity sensor 176' to selectively operate proximity switch 190'. Each of these components is similar to similarly named and numbered components described above with reference to FIGS. 4 and 5, except as described below.

Second substance communicating device 114' further has a substance connector component 122' and an electromagnetic connector component 222. First substance communicating device 112' has a substance connector component 124' and an electromagnetic connector component 224. Substance connector components 124' and 122' have complementary configurations that enable them to be coupled to one another, thereby establishing a substance pathway over which desired substances may be transferred between first substance communicating device 112' and second substance communicating device 114', and are similar to those described above with reference to FIGS. 4 and 5, such as by including a biasing member 143' to facilitate a reliable coupling.

Electromagnetic connector components 224 and 222 have complementary configurations that enable them to be coupled to one another, thereby establishing a electrical pathway over which power or data may be transferred between first substance communicating device 112' and second substance communicating device 114'. It will be appreciated that wireless power or data may alternatively be communicated between the electromagnetic connector components. Together, electromagnetic connector components 224 and 222 comprise an electromagnetic service connector system. The electromagnetic service connector system selectively permits the communication of power or data in response to the actuation of proximity switch 190' by proximity actuator 162'. As a result of the communications, controller 210 acts as a second proximity switch in that it senses, albeit indirectly, the engagement of device 112' and 114' so that it can effectively controller flow regulating devices 136'. In this case, controller 240 acts as a second proximity target or proximity actuator by communicating proximity information between 112' and 114' through the electromagnetic service connector system. In the case of a wireless interface between components 224 and 222, the second proximity actuator is a contactless proximity actuator. Electromagnetic connector component 222 may be enclosed within housing 115' of second substance communicating device 114'. Electromagnetic connector component 224 may be removable or non-removable from first substance communicating device 112'. Electromagnetic connector component 222 may be configured to transfer or receive power, data or both. Electromagnetic connector component 222 may be provided with a biasing member 243 performing a function similar to biasing member 143' to facilitate a reliable connection with electromagnetic connector component 224.

Electromagnetic connector component 224 may be connected by electrical lines 206 and 208 to a controller 210. Controller 210 is connected by electrical lines 212 and 214 to first flow regulating device 136' to provide a controlling signal to flow regulating device 136'. Controller 210 may provide the controlling signal in response to signals from other components. Electromagnetic connector component 222 may be connected by electrical lines 232 and 234 to a controller 240, which is selectively operable to provide the electromagnetic service to electromagnetic connector component 222. Controller 240 is connected in series with proximity sensor 176' and power supply 155' by electrical lines 242, 244 and 246 such that controller 240 receives a signal when proximity sensor 176' is closed as a result of the coupling of substance communicating devices 112' and 114'. Controller 240 may be connected by electrical lines 250 and 252 to a second flow regulating device 200. Additionally, controller 240 may be connected to controller 210 or to the first flow regulating device 136' for the operable control of the substance communication from substance provider 130'. Electrical lines 244 and 242 might directly connect to the first flow regulating device 136' via intermediate connections to electromagnetic connector system components 222 and 224 providing a direct control signal from proximity switch 190' to the first flow regulating device 136'. In another embodiment, electrical lines 244 and 242 might directly connect to the second flow regulating device 200 providing a direct control signal from proximity switch 190' to the second flow regulating device 200.

Flow regulating device 136', which may be a normally closed valve requiring power to be opened or a pump requiring power to operate, acts to prevent the communication of substance from first substance communication device 112'. Similarly, normally open proximity switch 190' and controller 240 prevent the flow of power or data from the second substance communicating device 114'. When second substance communication device 114' is coupled to first substance communication device 112', proximity switch 190' is closed, permitting the flow of power to controller 240. Controller 240 may then selectively supply power or data to the substance holder through connectors 222 and 224.

For some implementations, controller 240 may selectively operate second flow regulating device 200. It will be appreciated that, for some other implementations, controller 240 may be omitted and electrical line 232 may be connected to electrical 242 and electrical line 234 may be connected to electrical line 244 such that power will be provided directly by power supply 155' to first substance communication device 112' when proximity switch 190' is closed by the coupling of substance communication devices 112' and 114'.

Power or data communicated from second substance communication device 114' is received by controller 210, which may then selectively operate first flow regulating device 136' to permit the communication of substance from substance provider 130' to the substance consuming device 132'. Thus, the control of supply of substance is controlled indirectly by the action of proximity switch 144'.

For some implementations, controller 210 may be omitted and electrical lines 206 and 208 may be connected directly to first flow regulating device 136' to directly operate flow regulating device upon the delivery of power or data from second substance communicating device 114'. If both controllers 210 and 240 are eliminated, then flow regulating device 136' is powered directly by power supply 155' upon the closing of proximity switch 190'.

It will be appreciated that in implementations where controllers 210 or 240 are used, these controllers form a part of the system software architecture and electronics 15 described above with reference to FIGS. 1 and 2 and may incorporate portions of, for example, process control apparatus 14 or 28.

Figure 7:
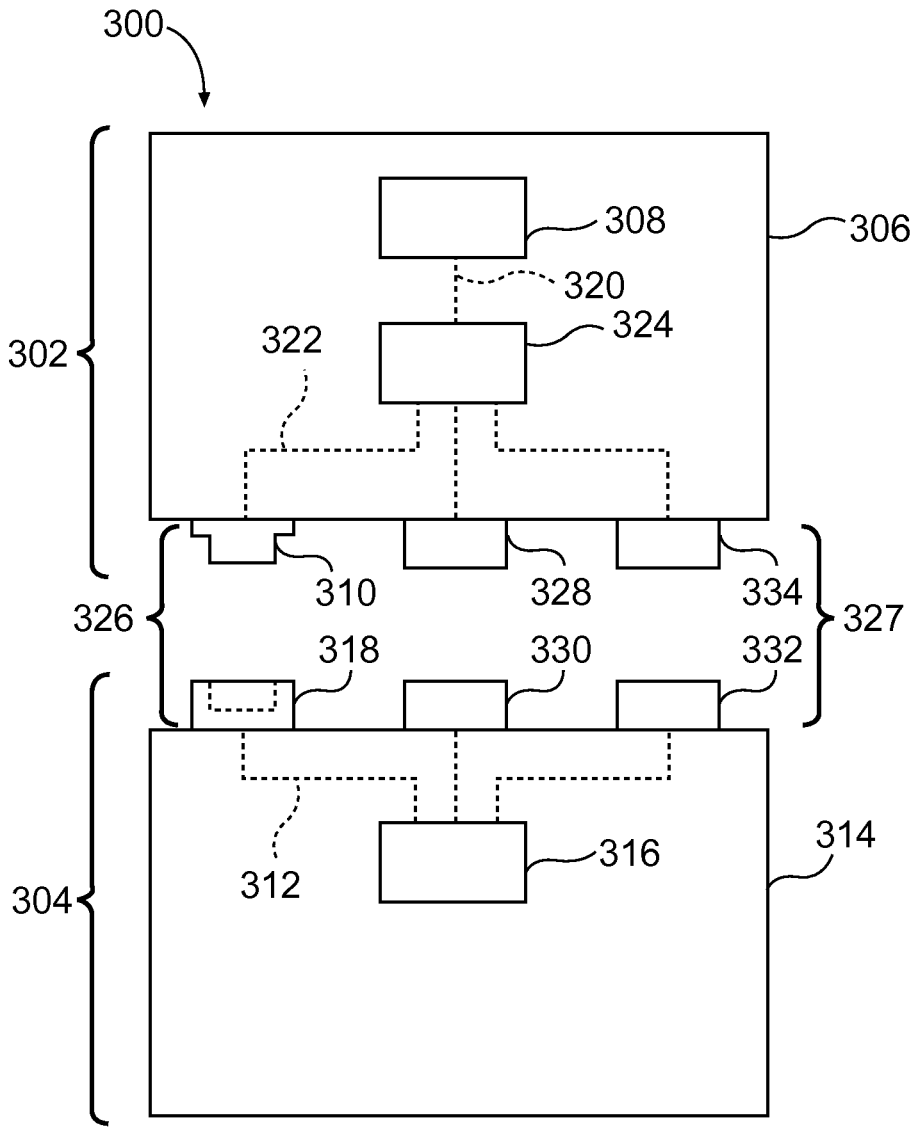
FIG. 7 is a schematic illustration showing a modular system including first and second substance communicating devices.

Referring to FIG. 7, a modular system 300 according to another embodiment of the invention is schematically illustrated. The modular system 300 includes a first service communicating device 302 that can be selectively coupled to a second service communicating device 304 for communicating a service therebetween. In one example, each service communicating device 302, 304 can be a substance communicating device, and the service can be a substance.

First service communicating device 302 may comprise a host 306, such as an appliance, having a service provider 308 connected to a first service connector component, such as a plug 310, by service lines 320 and 322, which can optionally be regulated by a service switch 324. If the service being communicated is a substance, the service switch 324 can comprise a switching valve.

Second service communicating device 304 may comprise an accessory device 314 with a main body and a service consumer 316 connected to a second service connector component, such as a receptacle 318, by service line 312.

The modular system 300 further comprises a service connector system 326. The service connector system 326 includes plug 310 and receptacle 318, which are selectively operably interengageable to permit the communication of a service between host 306 and accessory device 314.

The modular system 300 further comprises a proximity system 327. The proximity system 327 includes a first proximity system component 328, such as a proximity target, associated with host 306 and a second proximity system component 330, such as proximity switch including a proximity sensor, associated with accessory device 314 for detecting the presence of first proximity system component 328. The proximity system 327 can comprise a contactless or wireless proximity system; therefore, first and second proximity system components 328, 330 can comprise contactless components. The first and second proximity system components 328, 330 can be engaged with each other when the plug 310 and receptacle 318 are engaged with each other.

Second proximity system component 330 is operably coupled to the service switch 324 and can selectively activate the service switch 324 when plug 310 and receptacle 318 are engaged, as can be determined by the proximity sensor, to permit the communicating of the service from the service provider 308 to the engaged plug 310 and receptacle 318, and then subsequently along service line 312 to service consumer 316.

The modular system 300 can be configured to communicate more than one service. The proximity system 327 can optionally further include a third proximity system component 332 associated with accessory device 314 and a fourth proximity system component 334 associated with host 306 for detecting the presence of third proximity system component 332. The third and fourth proximity system components 332, 334 can be engaged with each other when the plug 310 and receptacle 318 are engaged with each other to selectively permit the communication of another service between host 306 and accessory device 314. The service communicated upon engagement of the third and fourth proximity system 332, 334 can be the same as or different from the service communicated upon engagement of the first and second proximity system components 328, 330. The fourth proximity system component 334 can be operably coupled to the service switch 324 and can selectively activate the service switch 324 when plug 310 and receptacle 318 are engaged to permit the communicating of the service from the service provider 308 to the service consumer 316. Alternatively, a separate service switch, service provider, and service consumer can be provided and associated with the third and fourth proximity system components 332, 334.

It will be appreciated that while accessory device 314 is illustrated as including the service consumer 316 and host 306 is illustrated as including the service provider 308, host 306 may alternatively or additionally include a substance consumer and accessory device 314 may alternatively or additionally include a substance provider. It will further be appreciated that while plug 310 is illustrated as being associated with service provider 308 and receptacle 318 is illustrated as being associated with service consumer 316, it is contemplated that plug 310 and receptacle 318 may be male or female connector components so long as the components are capable of interengaging to permit the transfer of service therebetween. Further, while the proximity target 328 is associated with host 306 such as proximity switch 330 including a proximity sensor is associated with the accessory device 314, the position of the target and switch could be reversed on the service communicating devices 302, 304.

Figure 8:
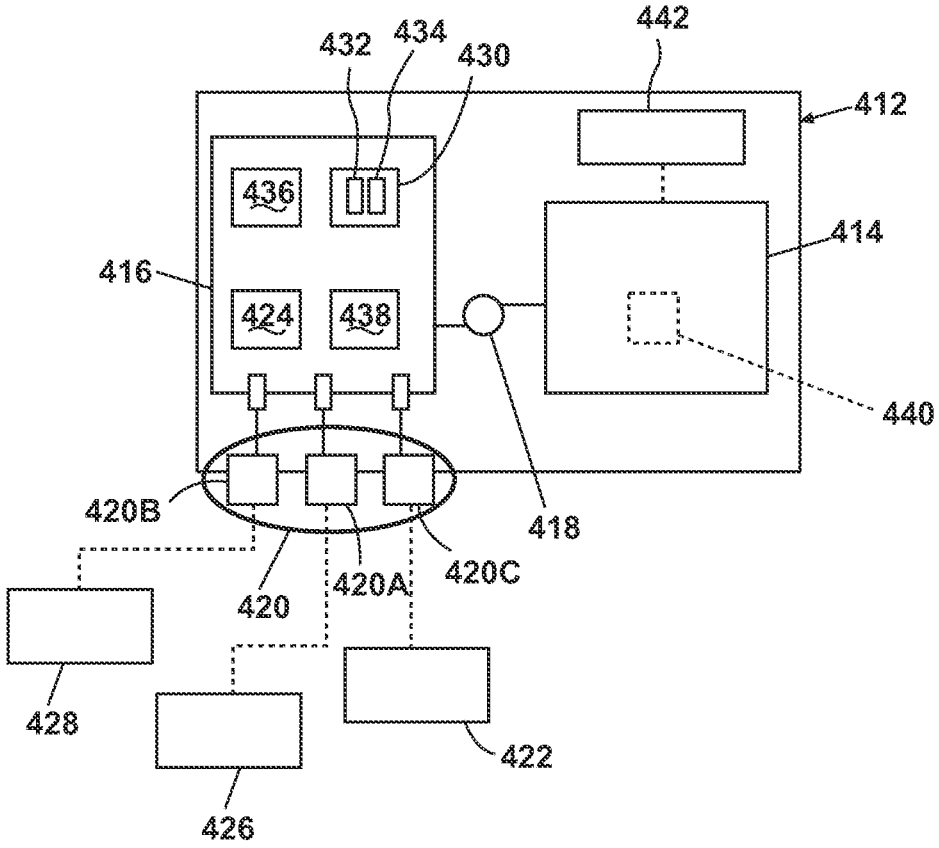
FIG. 8 is a schematic view of an appliance coupled to and comprising a consumable holder according to the invention.

Referring to FIG. 8, a modular system according to another embodiment of the invention is shown. The modular system comprises an appliance 412 having a process control apparatus 414 and a consumable holder 416. The appliance 412 is configured to perform an operation on a physical article, such as clothing or food, using a resource such as water, temperature-controlled air (hot or cold), steam, gas, electricity, and the like. The process control apparatus 414 is configured to implement and control a cycle comprising at least one operation. The process control apparatus 414 can comprise one or more components, such as electronic control boards, wiring and wiring harnesses, power-supplies, sensors integrated with the electronics as digital or analog inputs, and actuators like valves, relays, heaters, and the like, any or all of which can integrate with the electronics as digital or analog outputs.

The consumable holder 416 is configured to hold, carry, supply, communicate with, or otherwise interact directly with a consumable 424. The consumable holder 416 can be integral with the appliance 412, as for example, installed during manufacture and sold with the appliance, or it can be made and sold separately as an upgrade or addition. The consumable holder 416 can be disposed inside, outside, or on the appliance 412.

The appliance 412, the consumable holder 416, or both comprise at least one interface 418 to couple the appliance 412 and the consumable holder 416 to each other. The interface 418 can be an internal or external interface and can be configured to receive, connect to, or otherwise couple the consumable holder 416 and the appliance 412. One or more additional interface(s) 420 can couple the appliance 412 and/or the consumable holder 416 to an external source or device, such as a power source, a consumable source and/or a consumable reader.

The interface 418 can comprise at least one coupling point to couple the consumable holder 416 to the appliance 412, and the interface 420 can comprise at least one coupling point to couple the appliance 412 to an external resource or device, or couple the consumable holder 416 to an external resource or device. A coupling point can be a physical coupling, or an electrical or wireless coupling. For example, a coupling point can comprise a scanner and an image to be scanned, such as a barcode. Any coupling point in the interface 418 can be configured such that the consumable holder 416 can be selectively or permanently coupled to the appliance 412. Coupling points can also be used to couple electronics in a consumable holder to a device such as a sensor or actuator, or to couple electronics in an appliance to a device such as a sensor or actuator. In certain embodiments, electronics in a consumable holder can directly couple the appliance to a device such as a sensor or actuator with the use of a coupling point.

In the illustrated embodiment, a coupling point 420C can be configured for connection to a consumable reader 422. Alternatively, the consumable reader 422 can be incorporated into the appliance 412, and a sensor can be connected to the appliance 412 and/or the consumable reader 422 via the coupling point 420C. Further, a coupling point 420A can couple the consumable holder 416 to a bulk source 426 of a consumable 424, such as a large bottle of detergent. A coupling point 420B can also couple an external power source 428 to the appliance 412 or to the consumable holder 416.

Preferably, the appliance 412 and the process control apparatus 414 include software architecture 440 enabling the appliance to discover the consumable holder 416 using network messages. For this purpose, the process control apparatus 414 can comprise at least one functional identifier and can send or receive messages to for the discovery of functionalities, as discussed later. Likewise, the consumable holder 416 can also comprise an instance of the software architecture 440. Alternatively, consumable holder 416 can comprise a software component compatible with software architecture 440 such that at least one useful function associated with consumable holder 416 and appliance 412 can be realized when consumable holder 416 is coupled to appliance 412 using interface 418 and at least one message is transmitted between consumable holder 416 and appliance 412. In one example, the consumable holder 416 could send a message to appliance 412 indicating the presence of the consumable holder 416.

The appliance 412 can further comprise a user interface 442 coupled to the process control apparatus 414 for enabling user interaction with the appliance 412. The user interface 442 can be in communication with a source of information about a consumable, e.g. the consumable holder 416, performance tag, or data pod, and can display messages from the consumable 424. Messages could comprise warnings such as static warnings included with the source of information about the consumable 424 and dynamic warnings based on other information, such as information about the appliance 412, information reported by an appliance cycle of operation, a user, a user selection, and the use environment, or information associated with the consumable 424. For example, a warning could be that too much detergent was introduced into the wash for the cycle selections of small loads and delicate fabric. This kind of warning could be generated by the consumable holder 416 or the process control apparatus 414 and displayed on the user interface 442 and sent as a network message to any node in communication with the consumable holder 416 or appliance 412. The user interface 442 can be configured to render multi-media information in its communication of information to the user. Such multi-media information includes representations other than text. Examples of multi media information include sound clips, ring tones, songs, images, pictures, graphics, video clips, animations, office documents, PowerPoint slides, stylized text, boldness, size, and color, lines, shapes, symbols, and clip art.

The consumable holder 416 may further comprise electronics 430 configured for communication with the appliance process control apparatus 414. The electronics 430 can include a controller 432 and software architecture 434 similar to that of the appliance 412. The electronics 430 can be powered by the consumable holder 416 or via connection to the appliance 412.

The electronics 430 can affect a resource by communicating with the appliance process control apparatus 414 when the consumable holder 416 is coupled to an appliance 412. The electronics 430 can be configured to deliver a cycle of operation to the appliance 412. Alternatively, the electronics 430 can communicate with the software architecture 440 for the purposes of observing the cycle of operation and modifying the cycle of operation. The electronics 430 may observe the cycle of operation using a data collection scheme supported by the software architecture 440. In addition, the electronics 430 may alter the cycle of operation in response to the observations. The electronics 430 can alter the cycle of operation by requesting to the software architecture 440 that the process control apparatus 414 enter an alternate operating mode enabling the electronics 430 to directly control, partially or wholly, the cycle of operation. Alternately, the electronics 430 can alter the cycle of operation by making specific requests to the software architecture 440. Alternately, the electronics 430 can selectively alter a cycle structure 456 of the appliance 412 using any of the techniques described herein (see description of FIG. 11).

The consumable holder 416 can also have a consumable reader 436, similar to the aforementioned consumable reader 422 coupled to the consumable holder 416 by external coupling point 420C. In this case, the consumable reader 436 is communicatively coupled to the controller 432 and to the software architecture 434. This enables information about the consumable 424 and/or about the consumable holder 416 to be read from a source of information and transferred into the memory of the controller 432 or into the memory within the process control apparatus 414, wherein the transferring is preferably accomplished using software architecture 440.

The consumable holder 416 can have at least one sensor 438 to sense one or more attributes of a consumable 424 and/or its source 426. As discussed above, attributes can include such things as amount, brand, type, composition, structural form, expiration date, dispensing properties, nutritional information, temperature, pressure, and concentration. To store and inventory such data, the sensor 438 can be operably coupled to the controller 432. Such information or data can also be conveyed to and/or presented at a user interface in the consumable holder 416 or the appliance 412.

Figure 9:
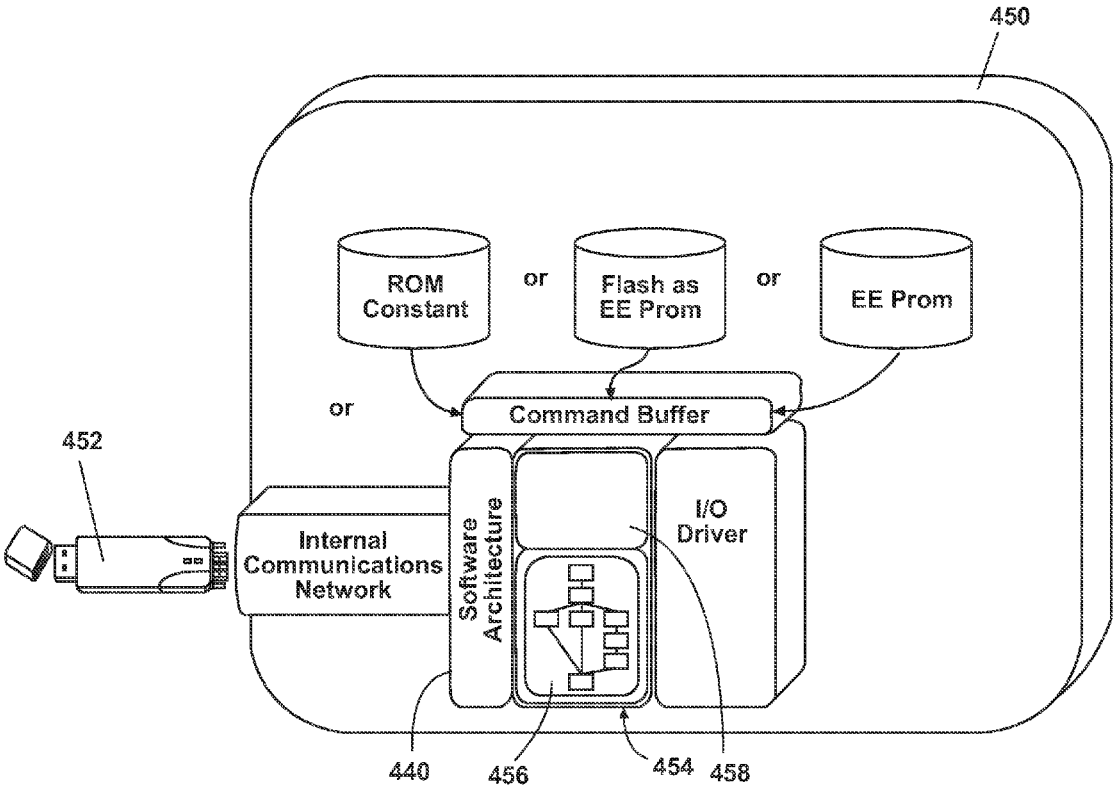
FIG. 9 is a schematic view of an appliance controller with a cycle architecture.

FIG. 9 illustrates an embodiment of the controller 450 of the appliance 412, one or more of which can be connected on a network, and to which additional operation cycles can be provided by an operation cycle component 452. The controller 450 controls the cycle of operation, and may further be operably coupled to a user interface 442 (FIG. 8) of the appliance 412 to enable user interaction with the appliance 412. Appliance 12 may have more than one controller 450 for controlling the cycle of operation.

Among other things, the controller 450 includes a cycle architecture 454. The cycle architecture 454 differs from conventional operational cycle execution software. Conventional operational cycle execution software is determined wholly from compiled source code that cannot easily be separated into constituent parts or portions. The cycle architecture 454 is software that has two distinct portions, a cycle structure 456 and a cycle engine 458. The cycle structure 456 is a data or cycle structure portion representing a plurality of elements or components comprising an ordered collection of steps, separated from each other by transition conditions, with the actions to be taken during each step. Each element or component can have an identifier to enable replacement or merging of elements or components. The transition conditions are the conditions under which a selected step should transition to a next step in the ordered collection of steps. Transition conditions comprise arbitrarily complex logic expressions that must be resolvable to a Boolean value. In one embodiment, the logic of a transition condition is a composition of structures comprising operators connected to functions, other operators, variables, or constants and functions connected to other functions, operators, variables, or constants wherein the composition forms a composite which can be resolved to a Boolean during the cycle of operation. For example, a logic expression could start with a structure representing an "AND" wherein the "AND" is connected to one "OR" structure and a function "foo". The "OR" structure is then connected to a function "bar" and a function "domo". During the cycle of operation where a first step was separated from a second step by the transition condition, the first step would de-activate and transition to the second step when function "foo" returned a value of true and either function "bar" or function "domo" returned a value of true. Compositions of structures representing logic can be represented in data, which can be converted into the composition of structures during or before the cycle of operation. Likewise, existing compositions can be modified with additional data. Using this data technique or another technique providing the same flexibility, cycle architecture 454 comprising cycle structure 456 further comprising a plurality of step transition logic expressions can be authored by an authoring tool, transmitted via network, encoded into consumable 424 or consumable holder 416, and used by cycle engine 458 to execute a cycle of operation. The cycle engine 458 is software that can be combined with at least one cycle structure 456 in the controller 450 for the execution of an operational cycle.

One advantage of having the cycle architecture 454 partitioned into two components is that the cycle engine 458 can reside in a plurality of different appliance types, thereby reducing the cost and increasing the quality of the appliance types. A second advantage is that new appliance models or types can be developed using the cycle engine 458, thus avoiding the development time and cost of conventional operational cycle execution software, which is typically and historically developed specifically for each new appliance model and type.

Another advantage of cycle architecture 454 is that the cycle architecture 454 can be in communication with cycle structure 456 over a network or within a runtime environment. This allows the logical architecture of the appliance 12 to vary independently from the physical architecture of the appliance 12.

Another advantage of cycle architecture 454 using cycle structure 456 and a separate cycle engine 458 is that the cycle structure 456 is portable, which allows it to be delivered to the cycle architecture 454 over a network, from a remote data source, from a local data source like flash memory, EE memory, or Read-Only Memory, or from an accessory, from a user interface configured to create a cycle structure, or from any source of information about a cycle structure or data about a cycle structure including data about a consumable. One example for delivering a cycle structure 456 is by the use of the operation cycle component 452. This advantage provides upgradeability to the appliance operational execution software in a less obtrusive approach than that of conventional operational cycle execution software in that the operational execution software can be changed in whole or in part without a complete re-downloading of the whole execution software running on the controller 450.

Another advantage of cycle architecture 454 using cycle structure 456 and a separate cycle engine 458 is that the cycle structure 456 can be altered to any degree even after the appliance 12 is installed and in use. This type of upgradeability can be delivered to the user in a variety of methods such as by authoring tools, cycle accessories, consumables with encoded cycle structures, network downloads, appliance user interface configured data, software patches and the like, or even by the operation cycle component 452. Conventional operational cycle execution software cannot be changed without a complete re-downloading of the whole execution software of controller 450. Further, conventional operational cycle execution software is configured to accept only parameters that vary the magnitudes of time, temperature, speed, and the like, or modify fixed actions within a fixed ordered collection of steps. By contrast, the cycle architecture 454 according to the invention is fully modifiable, allowing for new steps, re-ordered steps, new actions, new or modified transition conditions and the like.

The cycle structure 456 can be represented directly or indirectly. A direct representation of a cycle structure will provide an ordered collection of steps, transition conditions and actions, either logically or in an instruction set that can be interpreted by a cycle engine 458. An indirect representation of a cycle structure 456 will provide a set of instructions that will enable a creator, a converter, a compiler, or the cycle engine 458 itself to build an ordered collection of steps, transition conditions and actions.

Whether direct or indirect, the cycle structure 456 can be represented in a plurality of data structures such as key-value pairs, Extensible Markup Language (XML), relational data tables, comma separated variable files, a hierarchical composite tree or graph, byte arrays, data packets, command objects, binary encoded data, data encoded as a programming language such as a C header file, text, scripts, serialized objects, and messages. Regardless of the data structure of the cycle structure 456, the essential meaning and functionality will be interpreted to accomplish the same operational cycle execution on the controller 450. It is envisioned that cycle structure 456 may be transcribed from one data structure to another as appropriate during the authoring, distribution, and delivery of the cycle structure to the cycle architecture 454 on controller 450 without loss of meaning or functionality. It will be understood that data structure of cycle structure 456 are transferable between and can be resident in a plurality of memory types including RAM, ROM, and Read-Write types like Flash, EE, RW CDs, floppy disks, hard drives, portable memory thumb drives, external hard drives, and the like.

For an indirect representation of the cycle structure 456, a cycle structure creator can read a set of instructional messages, for example, and interpret them to build or create the cycle structure 456. Such instructional messages can be in the form of data packets for messages. For example, the data packets can have routing information such as an enabling identifier, one example of which can be a functional identifier representing things like a cycle structure creator, a state, a transition condition, or an action. As well, the data packets could have a collection of command identifiers that are supported via a collection of operation codes.

In an additional form of indirect representation, cycle structure 456 can be the source data for automatically generated compilable source code, or the cycle structure itself may be formatted such that it is directly compilable by a compiler configured to create an executable program appropriate for the controller 450.

Yet another form of indirect representation of the cycle structure 456 can be a plurality of cycle parameters like time temperature, speed, fill amount and the like wherein the cycle engine or an arbitrary software component would receive the cycle parameters and convert them to a direct representation of the cycle structure 456 or portion thereof.

In another form of indirect representation, cycle structure 456 can be represented as a script that is either compilable for the controller 68 or interpretable by a cycle structure creator or converter. A script can be created by a script authoring tool for introduction into the use environment in any of the disclosed embodiments. The script in communication with cycle architecture 454 is able to affect and change the state of the appliance control system as described herein.

For a direct representation of the cycle structure 456 where a data packet is used to deliver information about the cycle structure 456, the data packet can comprise routing information and a direct representation of the cycle structure 456. The direct representation could be encoded into a byte array. The byte array could then be operated on directly from cycle engine 458 configured to interpret the byte array by decoding the byte array during the interpretation such that the data in the byte array could be interpreted as an ordered collection of steps separated by transition conditions having transition logic wherein each step comprises a plurality of actions.

It is contemplated that cycle architecture 454 can have multiple sources of information about and/or representing a whole, a part of, or a modification to cycle structure 456 and that each source may either be a direct or indirect representation and that each source may be embodied in a variety of memory types. Accordingly, the information about the cycle structure 456 can be used to change the cycle structure 456 in the appliance 12 and thereby change an operation cycle of the appliance 12. The term "change the cycle structure" is contemplated to include creating a cycle structure, modifying a cycle structure, or accessing a whole or part of a cycle structure or a representation of a cycle structure.

It is further contemplated that the cycle architecture 454 may publish data about itself, its progress and information about the progress. For example, cycle architecture 454 can publish its current active step, conditions about the transition logic, elapsed time per step, total elapsed time, or sub-states of the steps, or sub-states of an ordered-collection of steps such as fault state, normal state, transitioning state, idle state, etc. The cycle architecture 454 may implement additional functionalities such as a software or network API allowing cycle architecture observers to register for notifications to receive the published data.

The cycle architecture 454 can be communicated, as well as be configured to communicate with a client to receive and send messages by routing information such as an enabling identifier, one example of which can be a functional identifier representing things like a cycle structure creator, a state, a transition condition, or an action. As well, the messages could have a collection of command identifiers that are supported via a collection of operation codes. Preferably, the cycle architecture 454 of any embodiment will receive messages from a client allowing for changes to the cycle structure 456. Changes to the cycle structure 456 may, for example, include the insertion or deletion of steps, additions or deletions to the actions of each step, or changes to the transitional logic between any two given steps. To accomplish such changes, identifiers must be associated with the components of the cycle structure such that the client messages can fully specify the exact desired modifications to the cycle structure.

The actions of the cycle architecture 454 cause the state of the appliance control system to change including, inter alia, changes to the appliance process control apparatus 414, a user interface, appliance software, and other components of the appliance like the screens on an appliance graphical user interface or some graphical component thereon. Other exemplary actions include changing the state of electro-mechanical actuators like relays, valves, and fans, and changing the state of user interface indicators like LEDs, buzzers, light rings, segmented displays, or graphics on a graphical LCD. Additionally actions of the cycle architecture 454 further comprise effects including hiding or making available user interface screens, making elements of screens visible, invisible, enabled, or disabled; changes to fonts, colors, size, or other attribute values of screen elements, changes to menu so that items could be enabled, disabled, added, and deleted, and the like. The devices to which the actions will apply may be represented as identifiable functions with a known controllable interface.

Routing information comprises identifiers (IDs) allowing a sender to send a message to a receiver. Examples of IDs which enable routing are network node IDs which identify the address of either the sending or receiving node on any given network. Another example of an ID which enables routing is a network ID uniquely identifying each network within a plurality of networks such that a sender could uniquely identify the destination (or receiver) of a message by with a network ID and a network node ID thereby allowing the network node IDs on each network vary independently while maintaining unique addressability by the combination of network ID and network node ID. Another example of an ID which enables routing is an object ID and method ID or an API ID and Op Code. These IDs provide routing from the sending node to the receiving software module or object within the receiving node. These IDs provide unique addressability within the software operating environment of a node. A routing table comprising a plurality of rows can be constructed having a combination of routing information IDs in each row where each row represents a route. An additional unique ID (a route ID) can be added to each row identifying each route thereby providing the sender a convenient mechanism for sending information. An example of a routing table is shown here:

| Routing ID | API ID | Sub-Net ID | Sub-Net Node ID |
|---|---|---|---|
| 4 | 35 | 1 | 1 |
| 5 | 46 | 2 | 2 |

Software can be constructed allowing the sender to send information to a route ID whereby the software with convert the route ID to the appropriate routing IDs such that the information is sent to the appropriate network and to the appropriate node on the network and to the appropriate receiving software module. In a further example wherein a sender on a first node communicates to a receiver on a third node via a second node, the second node can have a routing table linking, for example, the object ID to another route ID so that the message sent by the first node is appropriately propagated and routed to the third node by software on the second node using the routing table of the second node. Routing tables can be populated with routing information using the techniques described herein.

The operation cycle component 452 can store additional operation cycles, changes not originally provided with the appliance 412, or other information upon which a cycle of operation can be changed, and communicate with the appliance 412 such that the appliance can implement new, changed or additional operational cycles. An operation cycle stored by the operation cycle component 452 can also or alternatively include an updated operation cycle. The operation cycle component 452 can be any type of component, such as a hardware device that can plug into the appliance 412.

It is to be noted that the operational cycle component 452 can have other elements that are not the aforementioned operation cycles or constituent data and complied portions. For example, the operational cycle component 452 can include software code to configure the cycle engine 458 for communication and other functions or code to put software architecture into an alternate mode for the purpose of diagnostics or changing memory.

An appliance cycle of operation performed by the process control apparatus 414 can be optimized by information associated with the consumable 424 on which the process control apparatus 414 is operating. For example, the cycle structure 456 could be built specifically to accommodate some properties or attributes of the consumable 424 or to accommodate some properties or attributes of the consumable holder 416. The body or bodies that comprise information, identifiers of functionalities, properties, attributes, and property and attribute values related to consumable 424 can be referred to as sources of information about a consumable or "consumable information holders."

The information related to the consumable 424 can include at least one step for activating a user interface component, preparing an article, a substance communicating device, a substance or consumable, an object relating to the process of using the substance or consumable, or the appliance for the operation cycle, handling any of the above during the operation cycle, or handling any of the above after the operation cycle. The information can be at least partially derived from the consumable information holder. The information is adapted to be perceived by the consumable reader 422, which enabled to exchange data with a user interface, such as user interface 442. In this manner, when the consumable reader 422 obtains the information from the consumable information holder and the user interface 442 displays relevant data from the consumable reader 422, a user can utilize the information from the user interface in preparing for, handling during, and handling after the cycle of operation.

Examples of preparation steps include pre-wash for dishes, pre-treatment for clothes stains, defrosting frozen foods, applying ingredients like spices, oils, or condiments to food, shaking a liquid additive like a turkey baste solution, boiling a pot of water, removing a food item from a package and placing it in a micro-wave sleeve, mixing an egg with the contents of a box, checking inventory of needed ingredients, ordering ingredients, shopping for ingredients pushing certain buttons, making a selection on a user interface, rearranging articles in the appliance, checking the appliance, and the like.

Examples of handling steps during a cycle of operation include removing the article from the appliance for stirring, turning, flipping, applying ingredients like spices, oils, or condiments, and the like, adding a consumable or ingredient to the appliance, pushing certain buttons, making a selection on a user interface, rearranging articles in the appliance, closing and opening doors or lids, and the like.

Examples of steps to be taken after the cycle of operation is complete include cooling, applying ingredients like spices, oils, frostings or condiments, mixing with other foodstuffs, hanging up, hanging out, ironing, folding, initiating new preparation steps for another cycle of operation of an appliance for the article, consuming the article, arranging the article, drying the article, appropriately storing the article or preserving the article (as in refrigerating or freezing within an appropriate container for an appropriate amount of time), examining the article, replacing the article, replenishing the article or purchasing a new article, replenishing, ordering, or purchasing the consumables used in association with the article, subscribing to subscriptions associated with the article or the consumables used in association with the article, pushing certain buttons, making a selection on a user interface, rearranging articles in the appliance, cleaning surfaces, and the like.

Examples of consumable information holders include the consumable 424 itself, a data pod, the consumable holder 416, a user interface, and a tag. For example, the consumable holder 416 can be a sensing consumable information holder that uses a lid sensor 438 for sensing attributes about the consumable 424 contained therein. These attributes could then be used by the electronics 430 to further refine operation of the consumable holder 416. In use, if the consumable holder 416 needs to dispense two ounces of the consumable 424, a lid sensor 438 could be configured with an analog circuit coupled to the electronics 430 to provide a level or volume feedback so that the electronics 430 can dispense exactly two ounces rather than a time-based approximation.

Information associated with the consumable 424 can include amount and/or composition or other attributes that would characterize the magnitude of the usefulness of the consumable. In this case, the cycle architecture 454 may adapt itself based on the information. For example, if the consumable 424 were a dishwashing rinse aid and the consumable holder 416 had only 90% of the standard dose, the cycle architecture 454 may adapt itself to this condition by increasing the time of the rinse phase to compensate for the lack of rinse aid. Information associated with the consumable 424 can also include parameters of an operating cycle such as personal preferences of a user (e.g., doneness or crispiness preferences), and data about the consumable holder 416, the appliance 412, or other accessories or components thereof.

In a laundry-specific example, the process control apparatus 414 may provide information to the cycle architecture 454 about process variables like soil level, load size, soil type, etc. Based on the information associated with the consumable 424, including the process variable information, the cycle architecture 454 or an arbitrary software component in conjunction with a cycle engine 458 can reconfigure the cycle structure 456 to adapt to the process variable information. The consumable holder 416 may comprise the arbitrary software component and be able to reconfigure the cycle structure 456 to adapt to the process variable information. Reconfiguration can be accomplished in at least two ways. In one way, the arbitrary software component can read the cycle structure 456 and communicate with the cycle engine 458. In a second way, arbitrary software component can be preconfigured and communicate that configuration to or instruct the cycle engine 458 about the configuration.

One example of commands associated with an operating cycle is a collection of key value pairs. Keys comprise parameter names having a meaning, wherein the meaning is known by the cycle engine 458 such that values associated with the keys are thereby associated with the meanings. This enables the values to be used in the contexts of the meanings to modify and/or control the cycle of operation of the appliance 412.

The consumable holder 416, therefore, can contain all the functionality of and participate in all the embodiments that an operational cycle accessory in communication with the appliance 412 having the cycle architecture 454 can. Therefore in one embodiment, a consumable holder 416 is an operation cycle accessory that further physically contains and may also further be enabled to directly actuate the introduction of the consumable 424 into the appliance 412.

Looking again at FIG. 8, the consumable reader 422 is any device capable of retrieving data or information associated with the consumable 424 directly from a consumable information holder and exchanging data concerning the information by sending and receiving data. For example, the consumable reader 422 can inform memory in the consumable holder 416 of the type of consumable 424 being held therein.

Information associated with consumable 424, such as an operating cycle, a cycle structure, data about a cycle structure, data that can create or be interpreted to create a cycle structure, usage directions, cooking instructions, preparation instructions, dosage information, nutritional information, promotional and sale information, information about replenishment, offers for replenishment, reminders for replenishment, images and messages for user interface screens, and washing/drying instructions can persist, for example, within the consumable itself, in the packaging for the consumable 424, or in auxiliary materials, such as user manuals and performance tags, provided with the consumable 424. The consumable reader 422 is a component that can accept the information associated with the consumable 424 and transmit it elsewhere, such as to the controller 450 of the appliance 412. The consumable reader 422 can be a device integrated with the appliance 412 or with the consumable holder 416, or a separate device that can be coupled, either by a hardwire connection or wireless connection, to the appliance 412 or consumable holder 412 for communication. Examples of consumable readers 422 include, but are not limited to, bar code scanners, radio frequency identification (RFID) tag readers, imaging systems, cameras, intelligent vision systems, devices capable of NFC (near field communications), and magnetic strip readers enabled to send and receive data.

Figure 10:
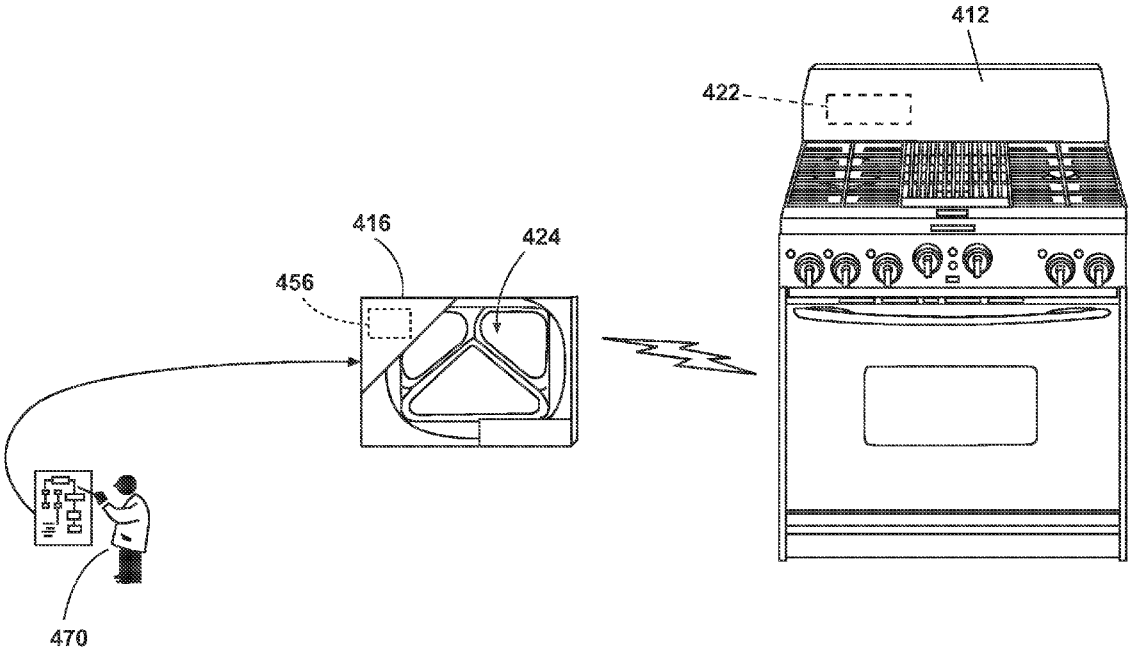
FIG. 10 is a schematic view of a consumable and a consumable reader according to one embodiment of the invention for use with a communicating appliance.

The consumable reader 422 communicates the information associated with the consumable 424 to the appliance 412 so that the appliance 412 can optimize its performance for the consumable 424. An example of employing the consumable 424 and consumable reader 422 is provided in the schematic illustration of FIG. 10. In this example, a consumable provider 470 determines the cycle structure 456 for the consumable 424. As illustrated, the consumable provider 470 is a food provider that determines cooking instructions (a cycle structure 456) for the consumable 424, which is in the form of a frozen meal, and encodes the consumable holder 416, which is the packaging for the frozen meal, with the cooking instructions. A user can place the consumable holder 416 in the vicinity of the appliance 412, which in this instance is an oven, and the consumable reader 422 of the appliance 412 reads the encoded cooking instructions from the consumable holder 416 and communicates the cooking instructions directly to the appliance 412. The cycle architecture 454 in the appliance 412 can then either execute the cooking instructions for preparing the frozen meal directly, or create a new or modify an existing cycle structure (i.e. an existing set of cooking instructions) in the appliance 412 without need for additional information from another source and without need for consumable-related lookup tables. The information associated with the consumable 424 can be self-executing.

The aforementioned example is not limited to the consumable provider 470 being a food provider. Any consumable provider with an authoring tool should be able to develop information about a consumable, preferably in a form appropriate for the creation of an optimum cycle structure 456 and user interaction with the appliance user interface, and encode the information into the consumable or onto the consumable holder so that when the consumable is introduced into the use environment, the optimum cycle structure and the optimal user interaction can be created within the cycle architecture 454 so the user will have an optimum experience. An authoring tool can comprise a computer with appropriate software, an appliance with software architecture, a network connecting the computer to the appliance for communication, or a data store for storing information about a consumable, preferably comprising information about a cycle structure and information for use on a user interface and preferably with at least one identifier identifying at least one appliance.

It is contemplated that information associated with the consumable 424 will be available from a data source that contains or can acquire the information associated with consumables. The information can include at least one cycle structure 456 corresponding to a preferred operating cycle for the consumable 424. In the case of a food item, the cycle structure 456 might be used to realize a complete cooking cycle definition for the food item. In this embodiment, the appliance 412, which is a cooking appliance, can comprise at least one instance of the cycle architecture 454 so that the introduction of the cycle structure 456 into the vicinity of the appliance 412 results in the creation or modification of the cycle structure 456, and initiation of a preferred operating cycle corresponding to the particular combination of the food item (consumable 424), the appliance 412, and other attributes, such as the geographic location and/or altitude of the appliance 412. Moreover, the consumable provider 470 may also encode cycle information comprising a sound, graphics, ring tone or other licensable information enabling the cycle architecture 454 to render the licensable information visually or audibly on behalf of the consumable provider 470.

It will be understood that information associated with consumable 424 can comprise data about the consumable, such as identifiers of functionalities, properties, attributes, and property and attribute values that describe or characterize something about the consumable 424 or its consumable holder 416. The data about the consumable can manifest itself in any type of data structure appropriate for useful storage and retrieval. Examples of appropriate data structures are given above. The data about the consumable may reside entirely within or upon the sources of information about the consumable 424 or consumable holder 416. Alternatively, the data about the consumable may be created by a second arbitrary software component using a combination of the cycle structure 456 and information associated with consumable 424. In either case, the data about the consumable is constructed from information associated with the consumable 424 or consumable holder 416 retrieved from a source of information about the consumable 424 or consumable holder 416.

Information associated with consumable 424 can also comprise user preferences that further refine the creation or modification of the cycle structure 456 to correspond to the preference of the user of the appliance 412. The consumable 424 and/or consumable holder 416 can also be enabled to identify the appliance 412 and provide an appliance-specific operating cycle. One manner of implementing this is for the consumable 424 and/or consumable holder 416 to have operating cycles corresponding to a particular appliance or class of appliance. The appliance 412 with which the consumable 424 and/or consumable holder 416 is used identifies and implements the relevant operating cycle. Another manner of implementation is for the consumable 424 and/or consumable holder 416 to have an identifier, and the appliance 412 to have access to a database or table of operating cycles for different consumables 424 and/or consumable holders 416. The appliance 412 takes the consumable identifier and looks up the corresponding operating cycle for the consumable.

Information associated with consumable 424 can be in any suitable form. In one embodiment, the information can be a communication packet that can be directly transmitted to the software architecture 440, thereby eliminating a need for a central storage of consumables data. In another embodiment, the information can be a key that can be used to direct the appliance 412 to stored consumables data.

The consumable 424 can be supplied by a third-party provider, as in the case of store-bought frozen meals and wash aids for laundry appliances and/or dishwashers, or provided by the user. Leftovers and other prepared food are examples of a consumable 424 that can be provided by the user. The prepared food can be placed in a storage container, which functions as a consumable holder 416 that is encoded with information related to the prepared food. For example, the information can include re-heat or cooking instructions and an expiration date (i.e., a throw-away date). When the information includes the expiration date, the appliance 412, such as the oven or microwave oven, can refuse to re-heat or cook the food if the current date is past the expiration date. Optionally, the appliance 412 can be configured to receive an override command from the user when the user desires to re-heat or cook the food despite the expiration date.

Any suitable material can be used to encode the information on the storage container, and examples include, but are not limited to, plastic wrap, aluminum foil, pots, pans, microwave-safe containers, container lids, and an adhesive or magnetic strip that can be placed on the storage container. The information can be configured by the person who originally prepared the food and encoded using any suitable means, such as a personal computer, a magnetic strip writer, or a handheld encoding device. With this configuration, the user can configure the information on the consumable 424 as desired. In this manner, the consumable holder 416 facilitates the acquisition of the data associated with consumables 424 from a data source.

Figure 11:
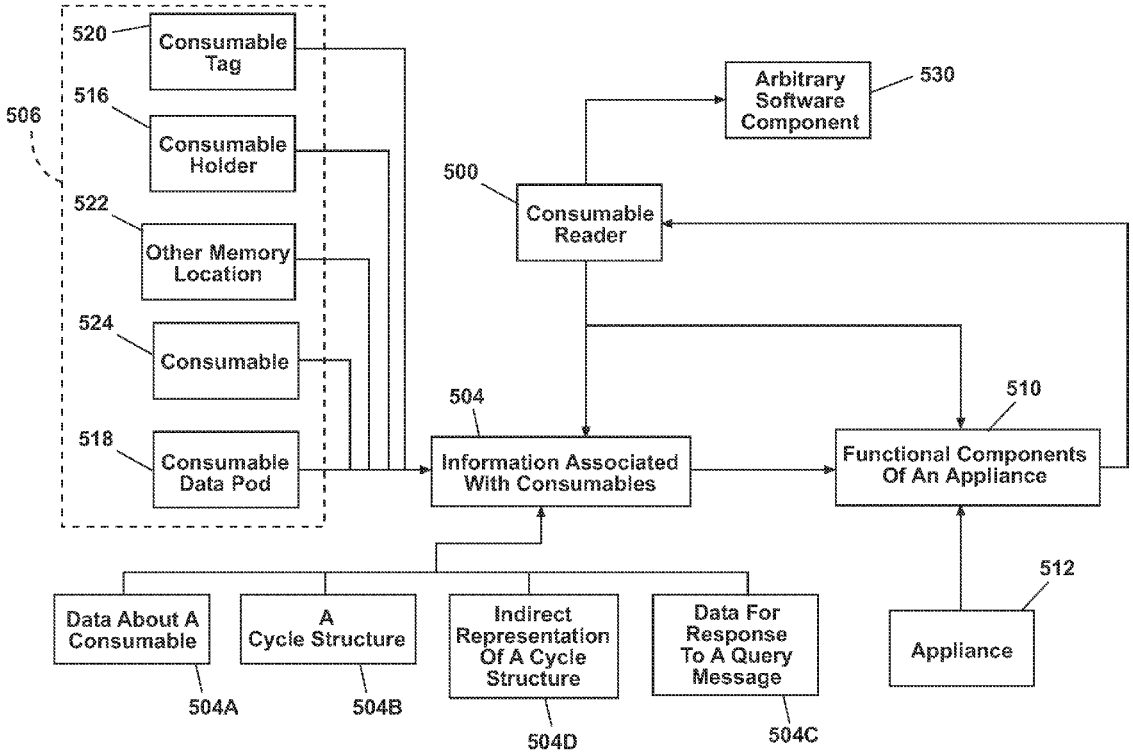
FIG. 11 is a schematic diagram showing the operation of a consumable reader with an appliance that is affected by information associated with a consumable.

Referring to FIG. 11, a consumable reader 500 is configured to obtain information associated with consumables 504. One or more consumable(s) 524 may be contained in one or more consumable holder(s) 516 similar to the aforementioned consumable holder 416. As discussed previously, the consumable 524 can be an article. In one embodiment, the appliance 512 comprises at least one instance of a cycle architecture, such as cycle architecture 454 of FIG. 9, and an optional cycle operations accessory or functional component 510. Typically, an appliance 512 similar to appliance 12 comprises the functional component 510. The information 504 by the consumable reader 500 can thus include not only data about a consumable 504A, but also a cycle structure 504B, data for a response to a query message from a functional component 504C, and indirect representations of a cycle structure 504D. Any or all of the data can optionally be in the form of at least one well formed message according to a packet structure or a portion thereof. As mentioned earlier, data about a cycle structure 504D can include direct commands to the functional component 510 or parameters about operating cycles, including user preferences or environmental parameters.

More examples of information 504 include the quantity of consumable pieces, quantity by volume or by weight, date of manufacture, manufacturer, data about its transit from manufacture, distributor, market, and consumer, data about the temperature during transit, nutritional information like calories, fat grams, percent daily allowance of essential vitamins and minerals, a list of medical conditions under which a consumable should not be consumed, data about the relationship between the consumable and known diets, known medical conditions, and known reactions to known medications, and the like. The information 504 can further include appliance or component identifier data in accord with the messaging protocol of the software architecture. Yet further, the information 504 can include condition of the consumable, initial conditions for the consumable, data relating to a fill process for the consumable holder, an attribute of the consumable, an attribute of a sensor, an attribute of the consumable holder, a notification trigger rule associated with the consumable, historical information about the consumable, usage instruction relating to the consumable, dietary and allergenic information relating to the consumable, purchasing information, advertising information, recipe information, supply chain information, ingredient information, usage information relating to the consumable, country of origin for at least one of a plurality of ingredients in a consumable, energy consumption attributed to the making and delivering, information relating to carbon emissions in the making and delivering, information relating to the un-natural agents used in the making and delivering, information relating to the environmentally friendly agents used in the making and delivering, information about the treatment of animals in the making and delivering, information relating to the working conditions used in the making and delivering, and information relating to the toxic agents used in the making and delivering. Information about un-natural agents associated with a consumable can include such things as data about pesticides, steroids, and fertilizers associated with the manufacture, delivery or composition of the consumable.

As mentioned earlier, the information 504 will be in a consumable information holder 506 that will typically be a memory location, which can be in the consumable holder 516, or on a surface on a consumable holder 516. Information can be stored on a removably coupled article comprising memory attached to the surface of the consumable holder 516. Information can also reside on the consumable 524 itself, such as by etching, embossing, or imprinting, as long as the consumable 524 is enabled to store retrievable information. An example of a consumable 524 enabled to store retrievable information would be food with information directly printed on or etched into the food using edible ink. Another option is a consumable data pod 518, which is an article comprising memory enabled to store retrievable information about a consumable. An example of the consumable data pod 518 is an article containing data about a consumable potentially further comprising consumable meta data. Consumable meta data can be such data as quantity of consumable pieces, quantity by volume or by weight, date of manufacture, manufacturer, data about its transit from manufacture, distributor, market, and consumer, data about the temperature during transit, nutritional information like calories, fat grams, percent daily allowance of essential vitamins and minerals, a list of medical conditions under which a consumable should not be consumed, data about the relationship between the consumable meta data and known diets, known medical conditions, known reactions to known medications, and the like. The consumable data pod 518 is preferably consumed by the appliance cycle of operation that also operates on the consumable 524 without degradation to the consumable 524 or to the overall objective of the process operating on the consumable. Information can also reside on a performance tag 520 attached or affixed to an article, as in the case of an RFID tag applied to the consumable holder 516 or an article to which the consumable 524 is intended to be applied.

As well, information can be stored in any other memory location 522, such as memory within a node in the appliance 512 or within the consumable reader 500 itself. The information associated with consumables 524 can be stored in removably coupled memory within the consumable reader 500. It should be understood that, in all cases, information associated with consumables 524 can further include appliance identifier data enabling the functional component to receive the most appropriate data about a consumable according to the connected appliance 512.

In one example, the functional component 510 detects the coupling of the consumable reader 500, queries the consumable reader for information associated with consumables 524, and a cycle structure 456 (see FIG. 9) is created according to the data about the consumable.

In another example, the consumable reader 500 is given or infers a 'start command' in which it selectively retrieves data about an operating cycle, changes the mode of a software operating layer of the appliance, and commands an alternate software layer of the appliance according to the data about an operating cycle. The consumable reader 500 can then retrieve data about an operating cycle, establish communication with the functional component 510, and create a cycle structure.

The consumable reader 500 can further comprise an arbitrary software component 530 which creates the cycle structure by communication with the API of the cycle engine.

In certain embodiments, at least one cycle structure is present in the memory of the consumable reader 500, and at least one cycle structure is present in the memory of at least one appliance functional component 510. The cycle structures can be functionally aggregated such that the cycle architecture is disposed to selectively operate in response to either cycle data structure. In this case, a user interface can be used to aggregate information about an appliance operating cycle from more than one component for display, modification, or selection by a user.

The functional component 510 can selectively detect the coupling of the consumable reader 500 to an appliance 512, and the consumable reader 500 is given or infers a 'start command'. Upon the selected event, the cycle of operation of the appliance 512 can obtain and communicate with the information associated with consumables 524. This direct communication with the information associated with consumables 524 is facilitated by the consumable reader 500 acting as a smart coupler.

A consumable information holder associated with any of a consumable, a consumable holder, an article, or an article holder could comprise data associated with proper steps of preparation, regulation, and post regulation (steps after the cycle of operation is complete) to take in accordance with the article or the use of at least one consumable with an article. The data could be practically rendered on a user interface in communication with the consumable information holder. An article could have more than one consumable information holder, and multiple articles, each having one ore more consumable information holders, can be operated on by an appliance at the same time. A device such as consumable reader can perceive the information from the consumable information holders and render the information to a user interface. The user interface can be interactive so that the user can be guided by the user interface to perform an ordered collection of steps comprising one or more preparation steps, handling steps and post handling steps. On an interactive user interface, the user can enter data affecting the ordered collection, including acknowledgement of the completion of steps, changing steps, actions and transition conditions in a cycle of operation, seeking help, asking inquiries, and the like.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In summary, it should be understood that the invention is capable of modification and variation and is limited only by the following claims.

All defined terms used in the claims are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A substance communicating device for use in conjunction with an appliance configured to perform a physical cycle of operation on an article using the substance communicating device, the appliance having a first substance service connector component and a first coupling component, the substance communicating device comprising:

a main body;

one of a substance consumer or a substance provider provided on the main body;

a substance line having a first end coupled with the one of the substance consumer or the substance provider and a second end remote from the first end;

a second substance service connector component provided on the main body and coupled with the second end of the substance line, the second substance service connector component being physically engageable with the first substance service connector component to form a substance pathway for the transfer of a substance between the first and second substance service connector components;

a second coupling component provided on the main body and configured to engage the first coupling component when the first and second substance service connector components are engaged to selectively permit the transfer of the substance between the first and second substance service connector components;

one of media, an interface for receiving media, or a media access component provided on the main body for providing information regarding the substance; and a communication interface provided on the main body for communicating the information to the appliance;

wherein the information communicated by the substance communicating device to the appliance is used by the appliance to affect the physical cycle of operation;

wherein the substance comprises a gas, liquid, or solid material.

2. The substance communicating device of claim 1 wherein the substance communicating device comprises the media.

3. The substance communicating device of claim 2 wherein the media includes a consumable information holder containing instructions to a user for one of:

preparing one of the article, the substance communicating device, the substance, an object relating to the process of using the substance, or the appliance for the physical cycle of operation;

handling one of the article, the substance communicating device, the substance, an object relating to the process of using the substance, or the appliance during the physical cycle of operation; or handling one of the article, the substance communicating device, the substance, an object relating to the process of using the substance, or the appliance after the physical cycle of operation;

wherein the consumable information holder provides at least a portion of the instructions to a user interface for rendering the at least a portion of the instructions on the user interface.

4. The substance communicating device of claim 3 wherein the object relating to the process of using the substance is one of a cleaning brush, a flavor brush, a baster, a flavor injector, a carving knife, a rub, a hanger, an iron, a drying cabinet, a clothes line, a warming drawer, tongs, or a pot holder.

5. The substance communicating device of claim 1 wherein the information is communicated to the appliance when the first and second substance service connector components are physically engaged.

6. The substance communicating device of claim 1 comprising the substance consumer, wherein the substance consumer comprises a holder for holding the substance and that is fluidly coupled with the first end of the substance line, wherein the holder receives the substance via the substance line when the first and second substance service connector components are engaged.

7. The substance communicating device of claim 1 comprising the substance provider, wherein the substance communicating device transfers both the substance and the information regarding the substance to the appliance when the first and second substance service connector components are engaged, wherein the appliance receives the substance and uses the information to affect the cycle of operation.

8. The substance communicating device of claim 7 wherein the substance comprises a chemistry for creating a desired effect on the article during the cycle of operation.

9. The substance communicating device of claim 1 further comprising a communication component operably coupled to the communication interface via a communication pathway.

10. The substance communicating device of claim 9 wherein the communication interface is one of an electrical connector, an optocoupler, an antenna, an LED, or a light pipe.

11. The substance communicating device of claim 9 wherein the communication component is one of a computer chip, a wireless radio, a transceiver, or an optocoupler.

12. The substance communicating device of claim 9 and further comprising a signal generator that generates a signal when the first and second coupling components are engaged, wherein the communication component detects the signal, and, in response to the detection of the signal, enables communication with the appliance via the communication pathway and the communication interface.

13. The substance communicating device of claim 9 wherein the communication component further comprises a code, wherein the code is sent by the communication component to the appliance via the communication pathway and the communication interface when the first and second substance service connector components are engaged.

14. The substance communicating device of claim 1 wherein the information includes at least one data value directly useable by the appliance without conversion or processing.

15. The substance communicating device of claim 14 wherein the information further includes an identifier identifying the data value.

16. The substance communicating device of claim 15 wherein the data value is a parameter for affecting the cycle of operation.

17. The substance communicating device of claim 1 further comprising the information, wherein the information includes data about a cycle structure useable by a cycle architecture of the appliance.

18. The substance communicating device of claim 17 wherein the information includes the cycle structure and the cycle architecture includes a cycle engine, and wherein the cycle engine can operate on the cycle structure to control the cycle of operation.

19. The substance communicating device of claim 18 wherein the cycle structure includes at least two states separated by at least one transition condition.

20. The substance communicating device of claim 19 wherein at least one of the at least two states includes at least one action, and wherein the cycle engine controls the cycle of operation by executing the at least one action.

21. The substance communicating device of claim 20 wherein the at least one action includes information for the cycle engine to send at least one of a network message, change a portion of a memory location in the memory of a controller, change the state of an actuator, change the state of a user interface component, or affect an electrical circuit.

22. The substance communicating device of claim 20 wherein the at least one transition condition includes a Boolean expression readable by the cycle engine to govern the transition from one of the at least two states to the other of the at least two states when the Boolean expression is resolved by the cycle engine to a logical true.

23. The substance communicating device of claim 22 wherein the Boolean expression includes at least one operator selected from AND, OR, Greater Than, Less Than, and Equal to and includes at least two of a constant value, a variable identifier, and a message identifier.

24. The substance communicating device of claim 1 wherein the substance communicating device is a removably coupled appliance accessory, and wherein the appliance accessory receives power from the appliance when the first and second service connector components are physically engaged.

25. The accessory of claim 24 wherein the appliance accessory is one of a dispenser of substance, a detergent dispenser, a drink dispenser, an ice dispenser, a flavoring dispenser, a chemical dispenser, a fragrance dispenser, a steam dispenser, a condiment dispenser, a food preparation ingredient dispenser, filter, a water filter, a refrigerator water filter, a bottle, a jug, a cartridge or a detergent cartridge.

26. The substance communicating device of claim 1 wherein the second coupling component is a contact proximity component configured to detect or be detected by the first coupling component by touching the first coupling component.

27. The substance communicating device of claim 1 further comprising a second actuating link moveably associated with the second coupling component and engageable with a first actuating link associated with the first coupling component, wherein, upon engagement of the second actuating link with the first actuating link, the substance is transferred between the substance communicating device and the appliance.

28. The substance communicating device of claim 27 wherein the second actuating link is movable between a first position in which substance is not transferred between the substance communicating device and the appliance, and a second position in which substance is transferred between the substance communicating device and the appliance, and wherein engagement of the second actuating link with the first actuating link moves the second actuating link to the second position.

29. The substance communicating device of claim 1 further comprising a flow regulating component provided on the main body for regulating the flow of the substance and a communication component operably coupled to the flow regulating component and determining if the first and second substance service connector components are engaged, wherein, upon determining that the first and second substance connector components are engaged, the communication component controls the flow regulating component to permit the flow of the substance.

30. The substance communicating device of claim 29 wherein the communication component comprises logic that determines that the first and second substance service connector components are engaged by observing the communication between the communication component and the appliance and issues a signal to the flow regulating component to permit the flow of substance in response to the determination.

31. The substance communicating device of claim 30 wherein the logic comprises at least one of a digital logic circuit, software, an electronic circuit, or an analog logic circuit.

32. The substance communicating device of claim 1 further comprising a flow regulating component provided on the main body for regulating the flow of the substance and a sensing component operably coupled to the flow regulating component and sensing the engagement of the first and second substance service connector components, wherein, upon the sensing component sensing the engagement, the sensing component provides a signal to the flow regulating component to permit the flow of the substance.

33. The substance communicating device of claim 32 wherein the sensing component is one of a contact proximity sensor or a contactless proximity sensor.

34. The substance communicating device of claim 1 wherein the second coupling component is a contactless proximity component.

35. The substance communicating device of claim 34 wherein the contactless proximity component is a contactless proximity target.

36. The substance communicating device of claim 35 wherein the contactless proximity target is a magnet.

37. The substance communicating device of claim 35 wherein the contactless proximity target provides a change in at least one of: an electromagnetic field; an electromagnetic wave; an acoustic wave; a visual target; an optical signal; a light wave; a chemical component; an electrical signal; a voltage; a current; a frequency; a resistance; an inductance; a capacitance; a mechanical signal; a pressure; a displacement; a vibration; or a chemical; wherein the change is communicated to the appliance to permit the transfer of the substance with the substance communicating device contemporaneously with the engagement of the first and second substance service connector components.

38. The substance communicating device of claim 37 wherein the contactless proximity target is compatible with a contactless proximity sensor of the appliance, and wherein the contactless proximity sensor can detect the change provided by the contactless proximity target to permit the transfer of the substance with the substance communicating device contemporaneously with the engagement of the first and second substance service connector components.

39. The substance communicating device of claim 1 wherein the substance includes chemistry for treating fabric.

40. The substance communicating device of claim 1 wherein the substance includes flavoring for treating a drink.

41. The substance communicating device of claim 1 wherein the media is selected from one of a computer memory, a flash memory, a USB flash drive, a SD Card, material with a printed bar code, or material with a coded image.

42. The substance communicating device of claim 1 wherein the interface for receiving media is an electrical connector.

43. The substance communicating device of claim 1 wherein the media access component is one of a computer chip, a wireless radio, a transceiver, or an optocoupler.

44. A consumable holder for use in conjunction with an appliance configured to perform a physical cycle of operation on an article using the consumable holder to provide at least one consumable, the appliance having a switch operably activated by the consumable holder, the consumable holder comprising:

a main body;

a structure provided on the main body for holding the at least one consumable within the main body;

a consumable information holder provided on the main body and comprising information associated with at least one of the article, the physical cycle of operation, or the at least one consumable; and an actuator provided on the main body for operably activating the switch;

wherein, when the actuator operably activates the switch, the appliance reads at least a portion of the information from the consumable information holder and uses the information to affect the cycle of operation on the article;

wherein the consumable comprises a gas, liquid, or solid material.

45. The consumable holder of claim 44 wherein the actuator is a proximity target.

46. The consumable holder of claim 45 wherein the proximity target is a contactless proximity target.

47. The consumable holder of claim 46 wherein the proximity target is a magnet.

48. The consumable holder of claim 46 wherein the contactless proximity target provides a change in at least one of: an electromagnetic field; an electromagnetic wave; an acoustic wave; a visual target; an optical signal; a light wave; a chemical component; an electrical signal; a voltage; a current; a frequency; a resistance; an inductance; a capacitance; a mechanical signal; a pressure; a displacement; a vibration; or a chemical; and wherein the change is used by the appliance to activate the switch.

49. The consumable holder of claim 48 wherein the contactless proximity target is compatible with a contactless proximity sensor of the appliance, and wherein the contactless proximity sensor can detect the change provided by the contactless proximity target to activate the switch.

50. The consumable holder of claim 45 wherein the proximity target is a contact proximity target.

51. The consumable holder of claim 50 wherein the contact proximity target is a second actuating link moveably associated with the main body and engageable with a first actuating link associated with the appliance, wherein, upon engagement of the second actuating link with the first actuating link, the switch is activated.

52. The consumable holder of claim 51 wherein the second actuating link is movable between a first position in which the switch is not activated, and a second position in which switch is activated, and wherein engagement of the second actuating link with the first actuating link moves the second actuating link to the second position.

* * * * *